US009336755B2

(12) United States Patent
VanHaight

(10) Patent No.: US 9,336,755 B2
(45) Date of Patent: May 10, 2016

(54) TREMOLO BAR AND ASSOCIATED ASSEMBLY AND TREMOLO ARM ACCESSORY

(71) Applicant: Douglas VanHaight, Stoughton, MA (US)

(72) Inventor: Douglas VanHaight, Stoughton, MA (US)

( * ) Notice: Subject to any disclaimer, the term of this patent is extended or adjusted under 35 U.S.C. 154(b) by 0 days.

(21) Appl. No.: 14/793,171

(22) Filed: Jul. 7, 2015

(65) Prior Publication Data

US 2016/0012804 A1 Jan. 14, 2016

Related U.S. Application Data

(60) Provisional application No. 62/022,329, filed on Jul. 9, 2014, provisional application No. 62/102,285, filed on Jan. 12, 2015.

(51) Int. Cl.
*G10D 13/06* (2006.01)
*G10D 3/14* (2006.01)

(52) U.S. Cl.
CPC ..... *G10D 3/146* (2013.01)

(58) Field of Classification Search
CPC ..... G10D 3/146
See application file for complete search history.

(56) References Cited

U.S. PATENT DOCUMENTS 2,741,146 A 4/1956 Fender
2,825,256 A * 3/1958 Smallwood ..... G10D 3/146 84/313
4,516,462 A * 5/1985 Schulze ..... G10D 3/146 84/313
4,782,732 A * 11/1988 Kato ..... G10D 3/146 84/313
4,852,448 A * 8/1989 Hennessey ..... G10D 3/146 84/313
5,194,679 A * 3/1993 Cohen ..... G10D 3/146 84/313
5,400,684 A * 3/1995 Duffy ..... G10D 3/146 84/313
5,637,817 A 6/1997 Sherman
5,641,923 A 6/1997 Merski
5,942,703 A * 8/1999 Boehnlein ..... G10D 3/146 84/313
7,247,780 B2 7/2007 Sanders et al.
7,745,709 B2 * 6/2010 Benjamin ..... G10D 3/146 84/313
8,575,464 B1 * 11/2013 Butterworth, III ..... G10D 3/146 84/313
2015/0027293 A1 * 1/2015 Young ..... G10D 1/085 84/313
2016/0012804 A1 * 1/2016 VanHaight ..... G10D 3/146 84/313

* cited by examiner

*Primary Examiner* — Robert W Horn
(74) *Attorney, Agent, or Firm* — Daly, Crowley, Mofford & Durkee, LLP

(57) ABSTRACT

An assembly for attachment to a guitar includes a first elongated member having first and second opposing ends arranged along a major axis of the first elongated member. The assembly also includes a bridge engagement mechanism coupled to the first elongated member and configured to couple a bridge of the guitar. The assembly additionally includes a second elongated member having a first region proximate to a first end of the second elongated member and a second region. The first and second regions of the second elongated member are arranged along a major axis of the second elongated member with the first end of the second elongated member coupled to the first elongated member. Further, the major axis of the second elongated member is rigidly arranged or movably arranged to be within about forty-five degrees of perpendicular to the major axis of the first elongated member.

35 Claims, 38 Drawing Sheets

TREMOLO BAR AND ASSOCIATED ASSEMBLY AND TREMOLO ARM ACCESSORY

CROSS REFERENCE TO RELATED APPLICATIONS

This application claims the benefit of U.S. Provisional Application No. 62/022,329 filed on Jul. 9, 2014 under 35 U.S.C. §119(e), and of U.S. Provisional Application No. 62/102,285 filed on Jan. 12, 2015 under 35 U.S.C. §119(e), which applications are hereby incorporated herein by reference in their entirety.

STATEMENT REGARDING FEDERALLY SPONSORED RESEARCH

Not Applicable.

FIELD

This disclosure relates generally to tremolo bars for a guitar and, more particularly, to a tremolo assembly for attachment to a guitar and accessories attached thereto.

BACKGROUND

Tremolo (or "whammy") bars can be found on certain types of guitars (e.g., electric guitars) and are generally used, at least in part, to change the pitch of sounds produced by such guitars. Typically, tremolo bars are attached to a bridge section of a guitar (comprising a bridge assembly that anchors strings to the body of the guitar) and are capable of pivoting in a clockwise or counter-clockwise direction with respect to the body of the guitar and capable of being pushed towards the body of the guitar. In one application, the pitch of sounds produced by the guitar can be changed by applying a force to the tremolo bar in a direction away from the body of the guitar (e.g., for Stratocaster style guitars having a "floating bridge" arrangement). In another application, the pitch can be changed by applying a force to the tremolo bar in a direction towards the body of the guitar (e.g., for Stratocaster and Bigsby® style guitars). Conventionally, in order to access and use the tremolo bar, a user may need to switch positions of his or her hands from the strings of the guitar to the tremolo bar, which can result in undesirable interrupted play.

It would be desirable to provide an assembly (or improved tremolo bar) that is capable of taking advantage of the position of a user's body (hand, wrist, or otherwise) with respect a guitar such that the user does not need to switch positions of his or her hands from the strings of the guitar to the assembly. It would be further desirable to provide an associated elongated member that is capable of being coupled to substantially any tremolo bar and operable to provide for substantially the same functionality of the assembly.

SUMMARY

The present disclosure provides an assembly for attachment to a guitar having a guitar body, a neck, a plurality of strings, and a bridge with the plurality of strings disposed above at least the guitar body and extending between the bridge and the neck, the bridge coupled to the guitar body and the plurality of strings, and the guitar body having a first end distal from the neck and a second end proximate to the neck. The assembly is capable of taking advantage of the position of a user's body (hand, wrist, or otherwise) with respect a guitar such that the user does not need to switch positions of his or her hands from the strings of the guitar to use the assembly and the tremolo bar functionality of the guitar. In some embodiments, the present disclosure also provides an elongated member that is capable of being coupled to substantially any existing or new tremolo bar and operable to provide enhanced tremolo functionality.

In one aspect of the concepts described herein, an assembly for attachment to a guitar includes a first elongated member having first and second opposing ends arranged along a major axis of the first elongated member. The assembly also includes a bridge engagement mechanism coupled to the first elongated member and configured to couple the bridge of the guitar. The assembly additionally includes a second elongated member having a first region proximate to a first end of the second elongated member and a second region. The first and second regions of the second elongated member are arranged along a major axis of the second elongated member with the first end of the second elongated member coupled to the first elongated member. Further, the major axis of the second elongated member is rigidly arranged or movably arranged to be within about forty-five degrees of perpendicular to the major axis of the first elongated member. Moreover, the major axis of the second elongated member is rigidly arranged or movably arranged to be within about forty-five degrees of perpendicular to a line parallel to the plurality of strings. A center of the second elongated member is disposed along the line parallel to the plurality of strings.

In some arrangements, the second elongated member can be at a position over the plurality of strings and at a position operable by a forearm or wrist of a person. In other embodiments, the second elongated member can be at a position not over the plurality of strings, but more toward the above-described first end of the body of the guitar, and at a position operable by a forearm of a person

BRIEF DESCRIPTION OF THE DRAWINGS

The foregoing features of the disclosure, as well as the disclosure itself may be more carefully understood from the following detailed description of the drawings, in which.

Figure 1:
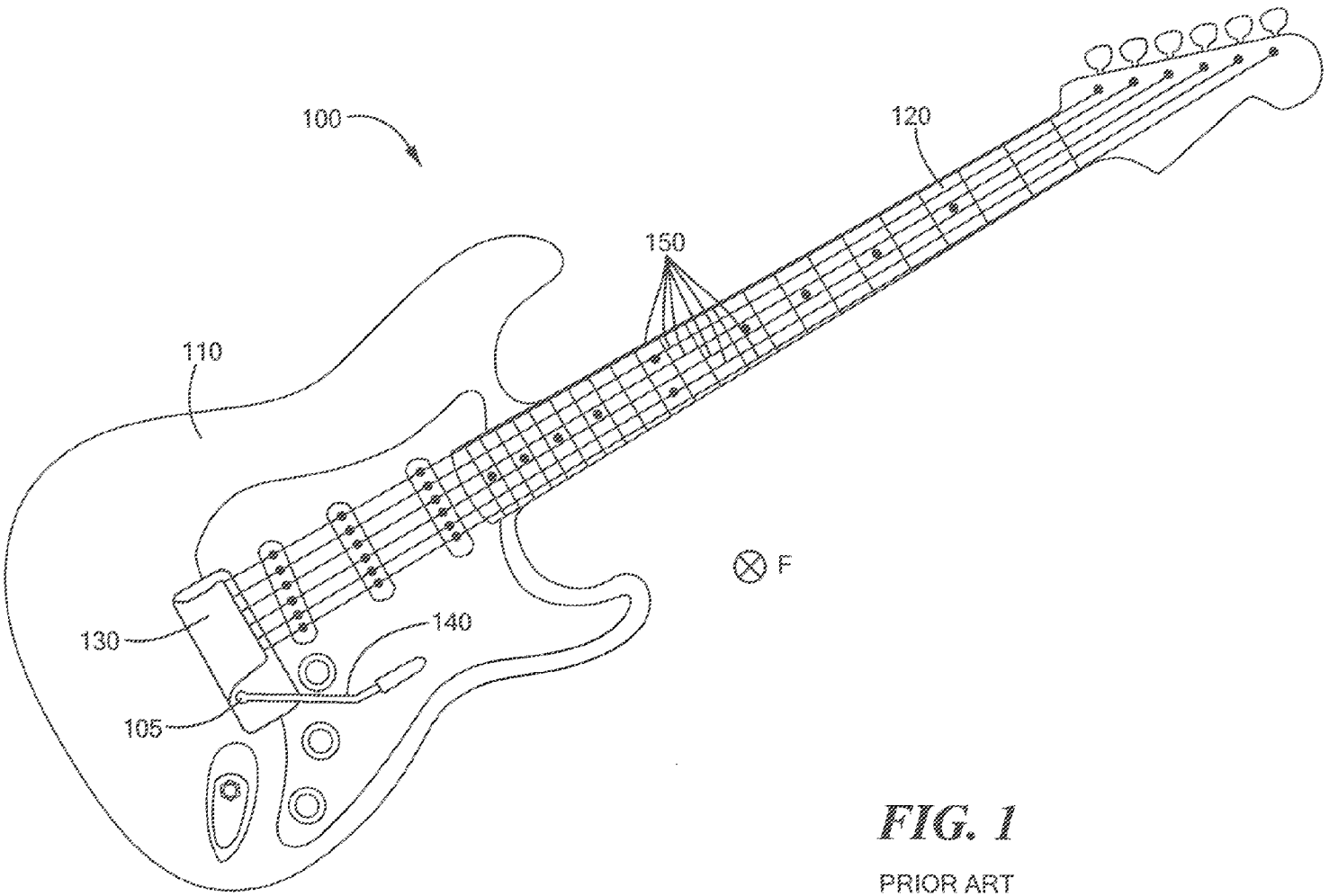
FIG. 1 PRIOR ART
FIG. 1 is a pictorial showing an example guitar with a conventional tremolo bar.
Figure 26:
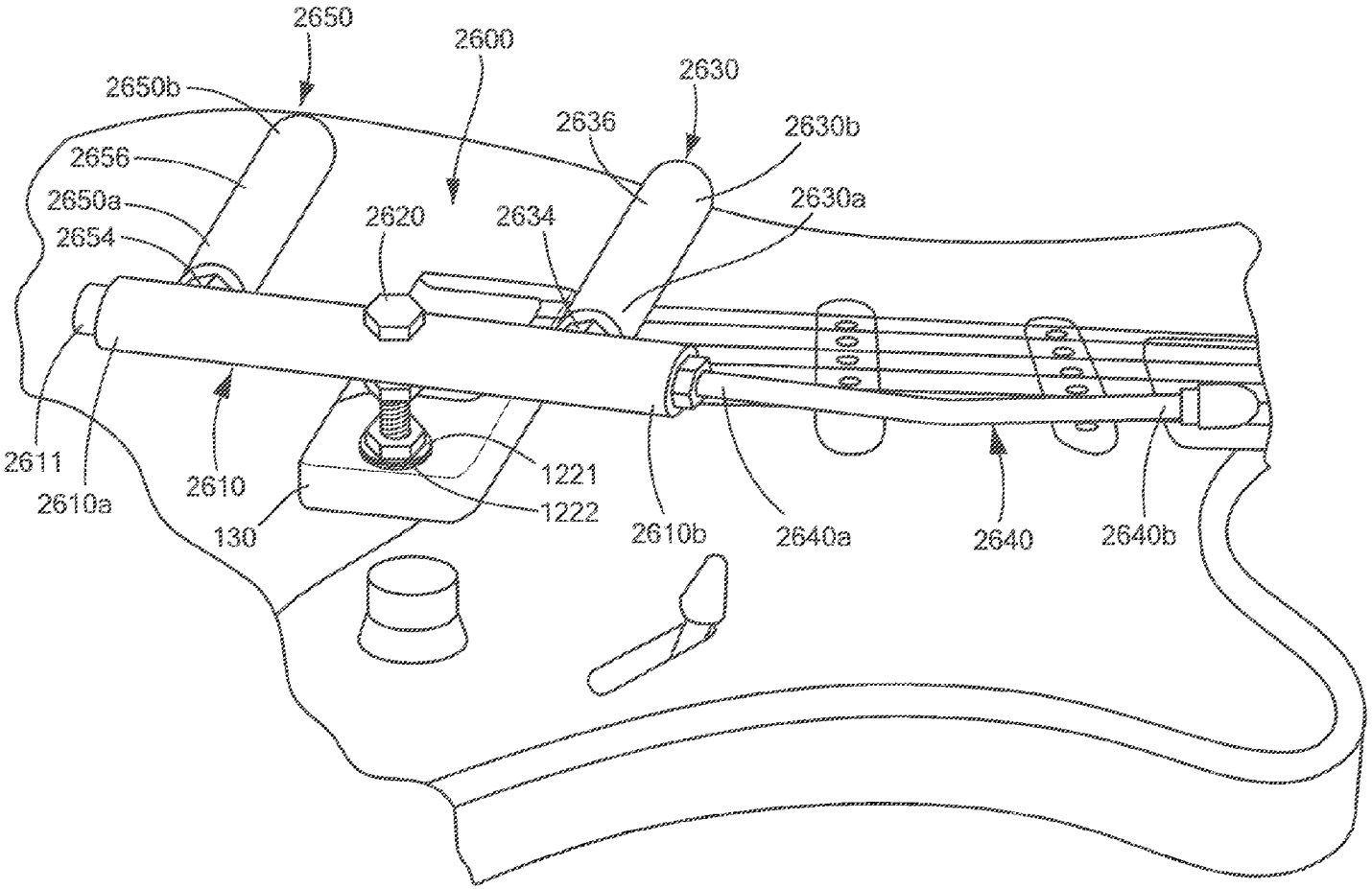
Figure 27:
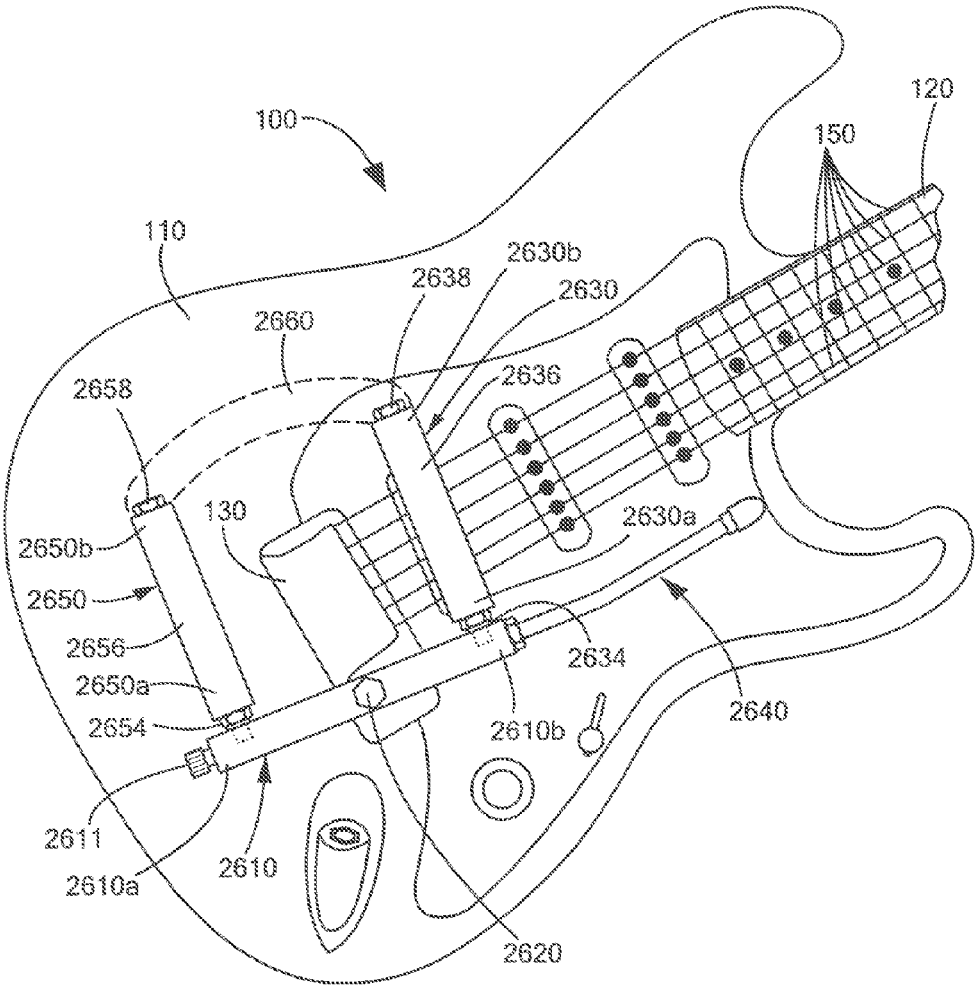
Figure 28:
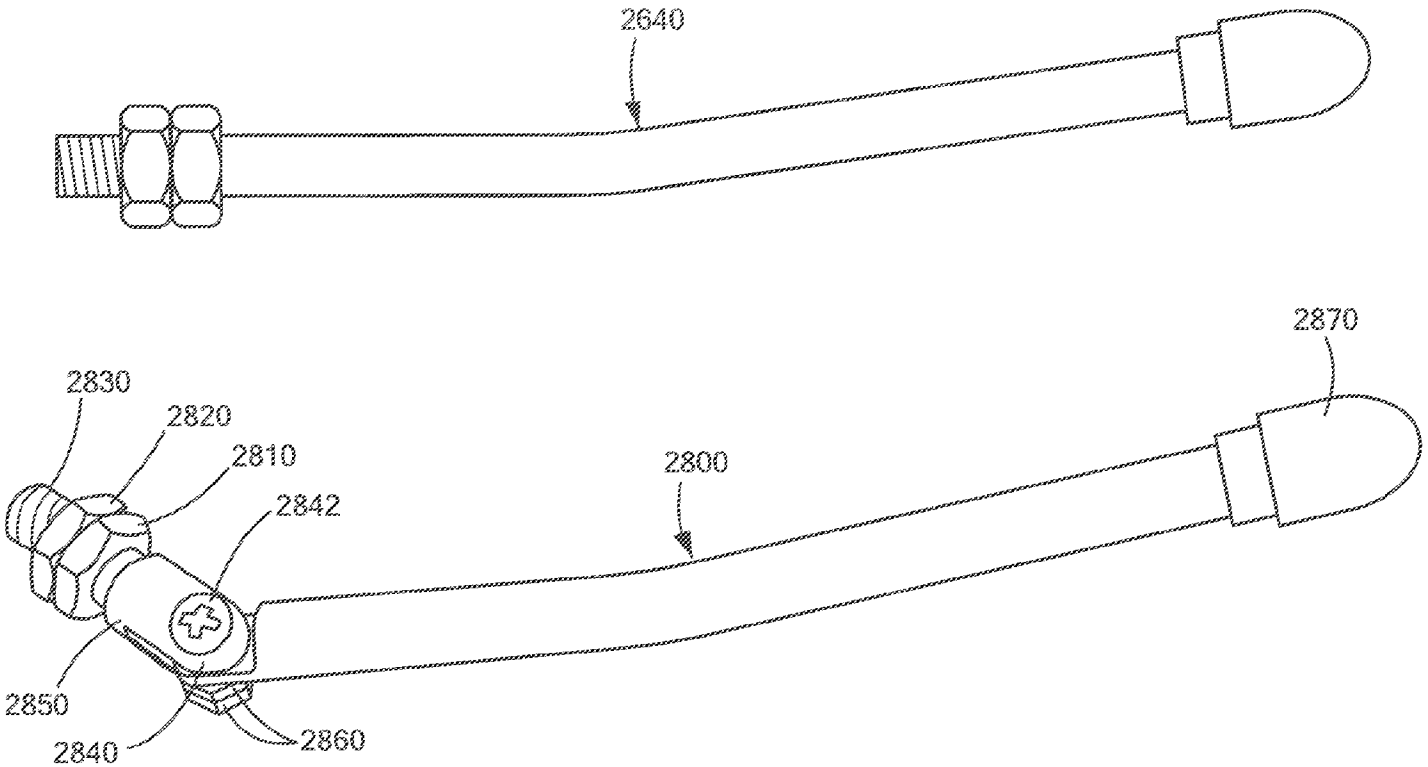
Figure 29:
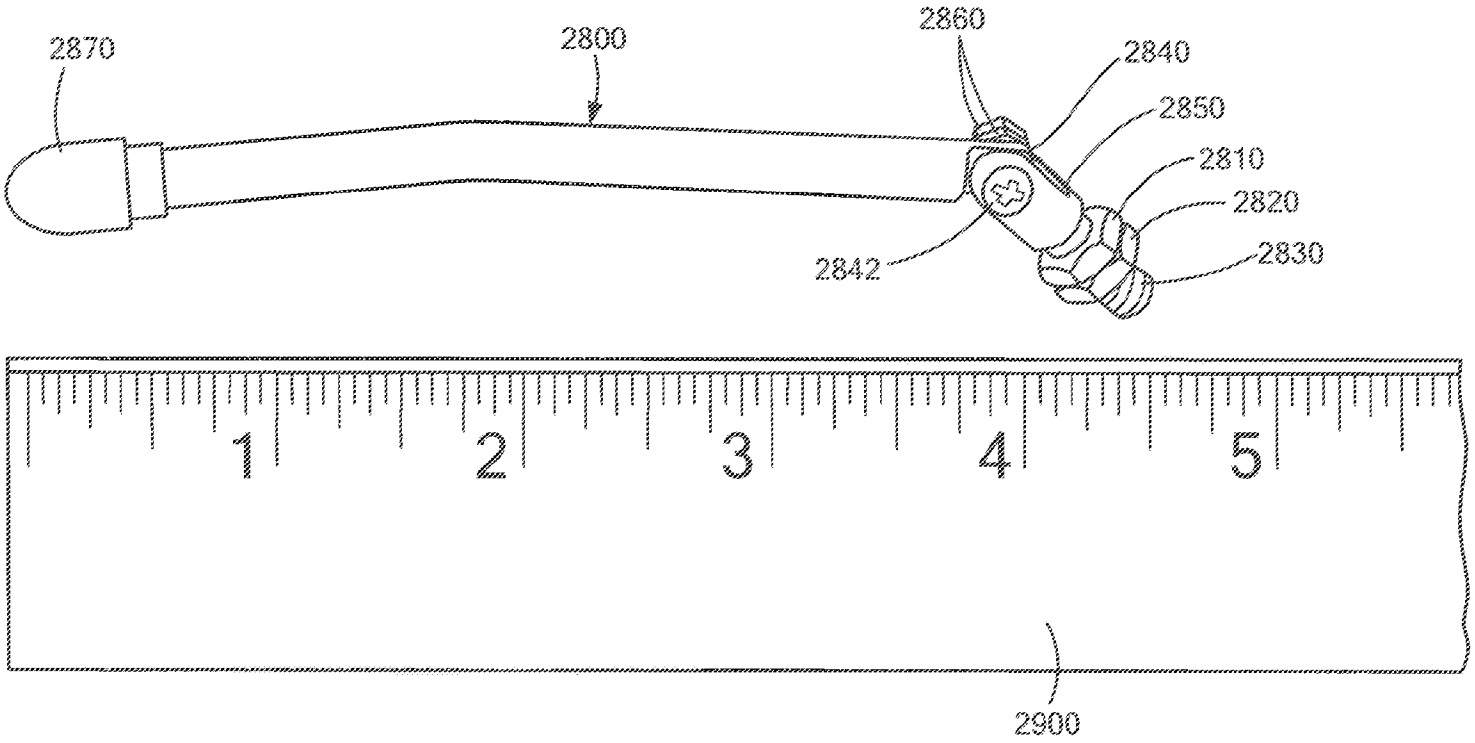
Figure 30:
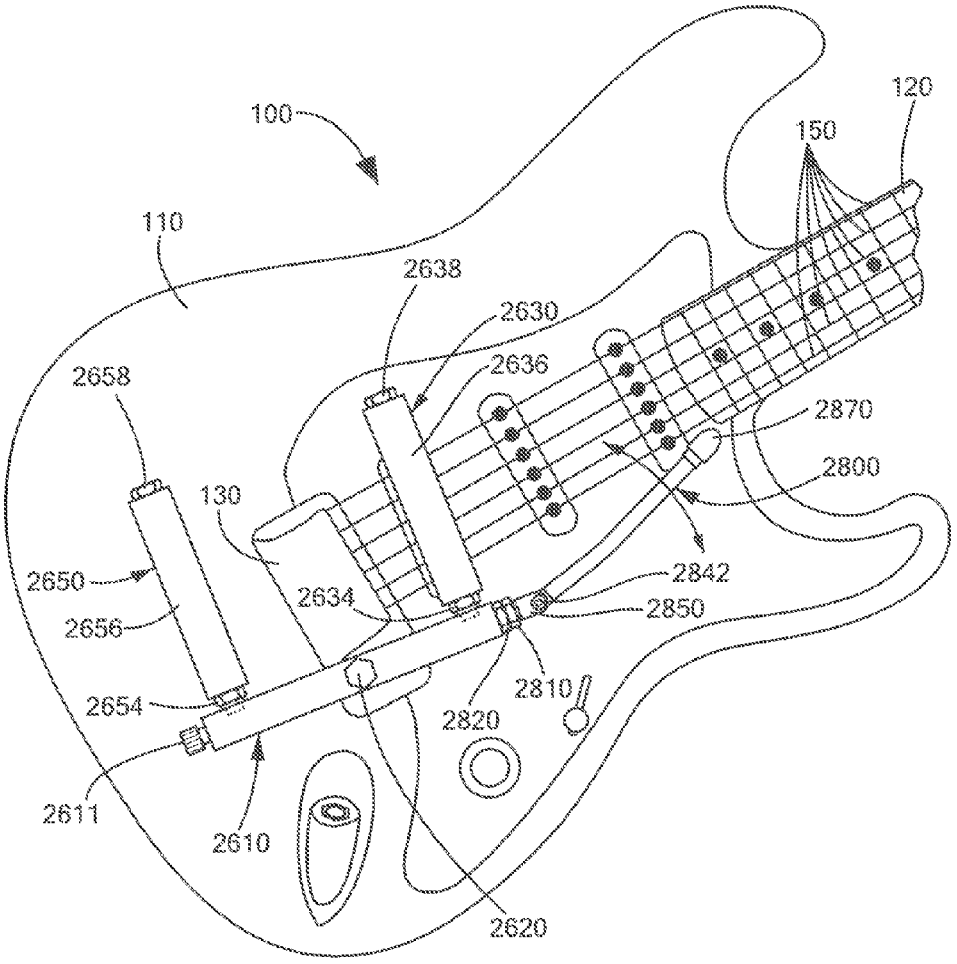
Figure 31:
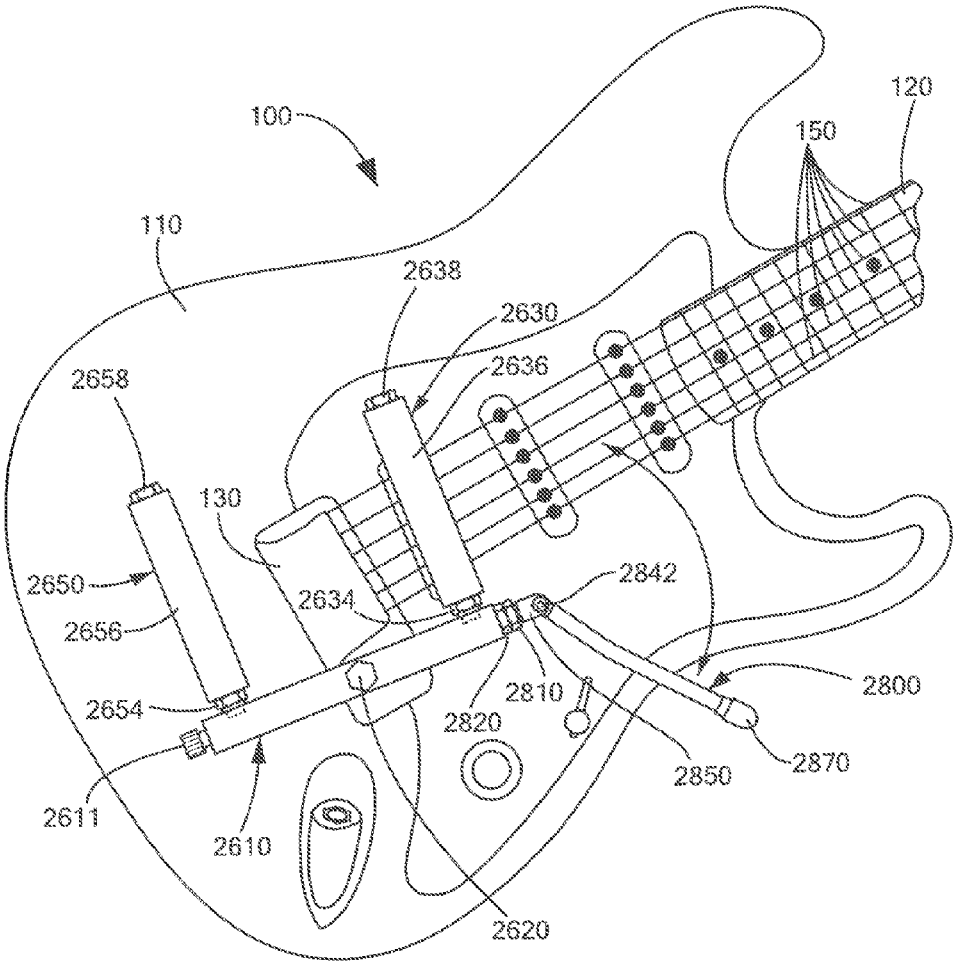
Figure 32:
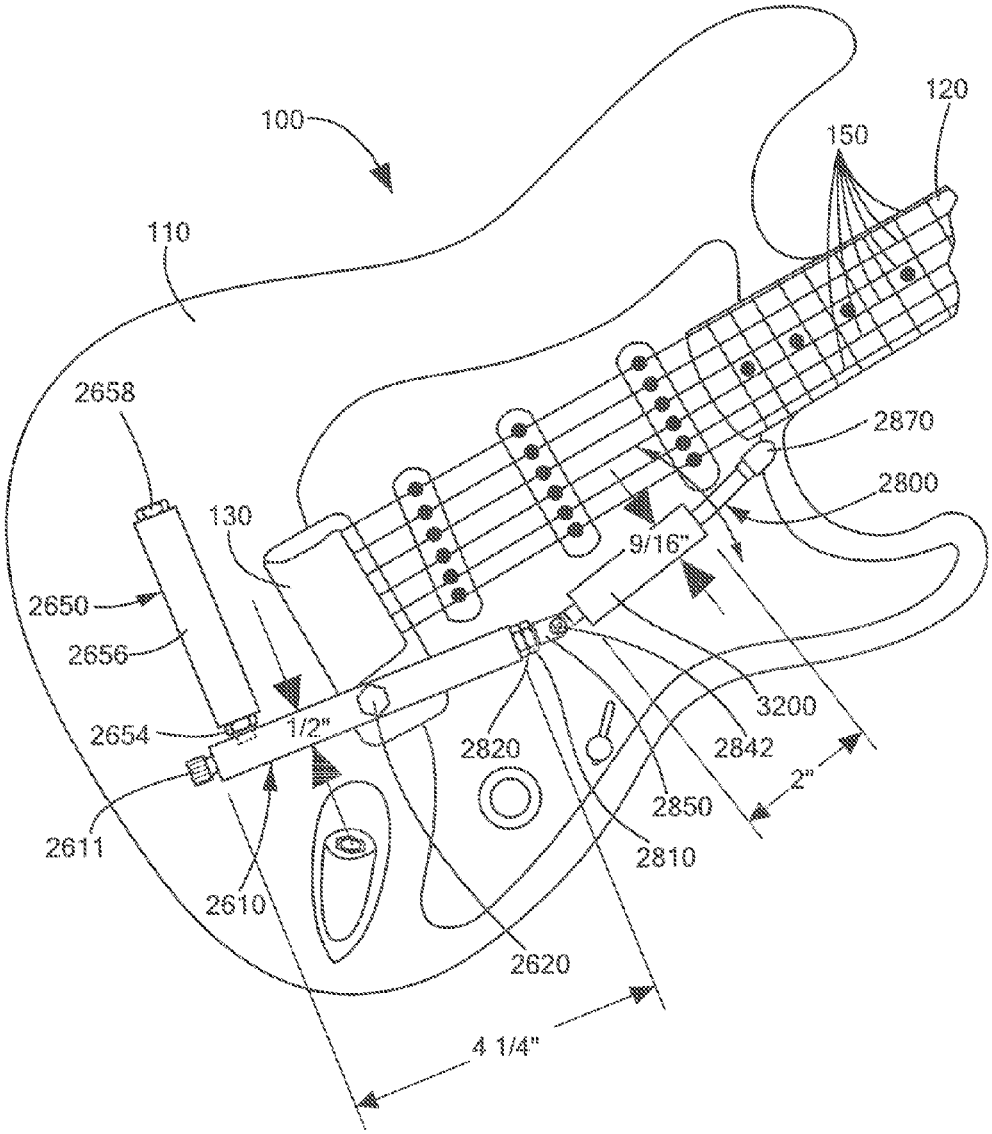
Figure 33:
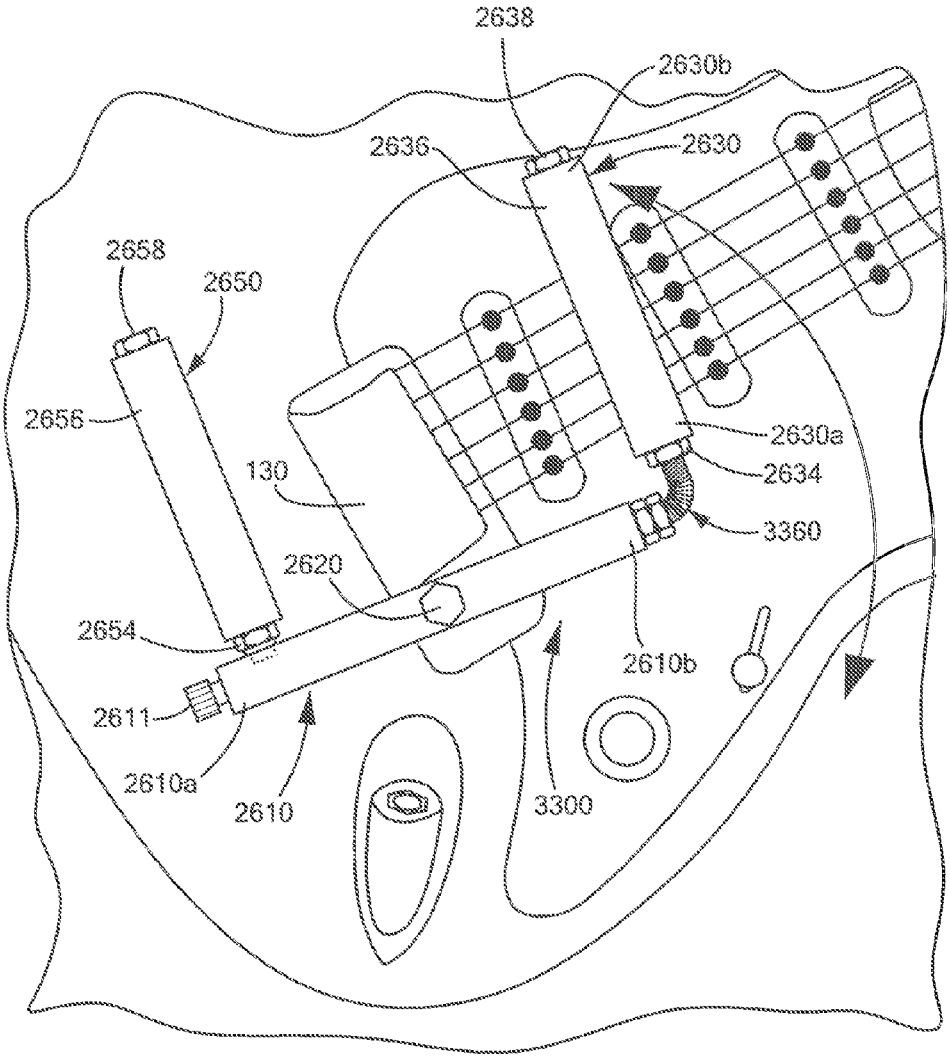
Figure 34:
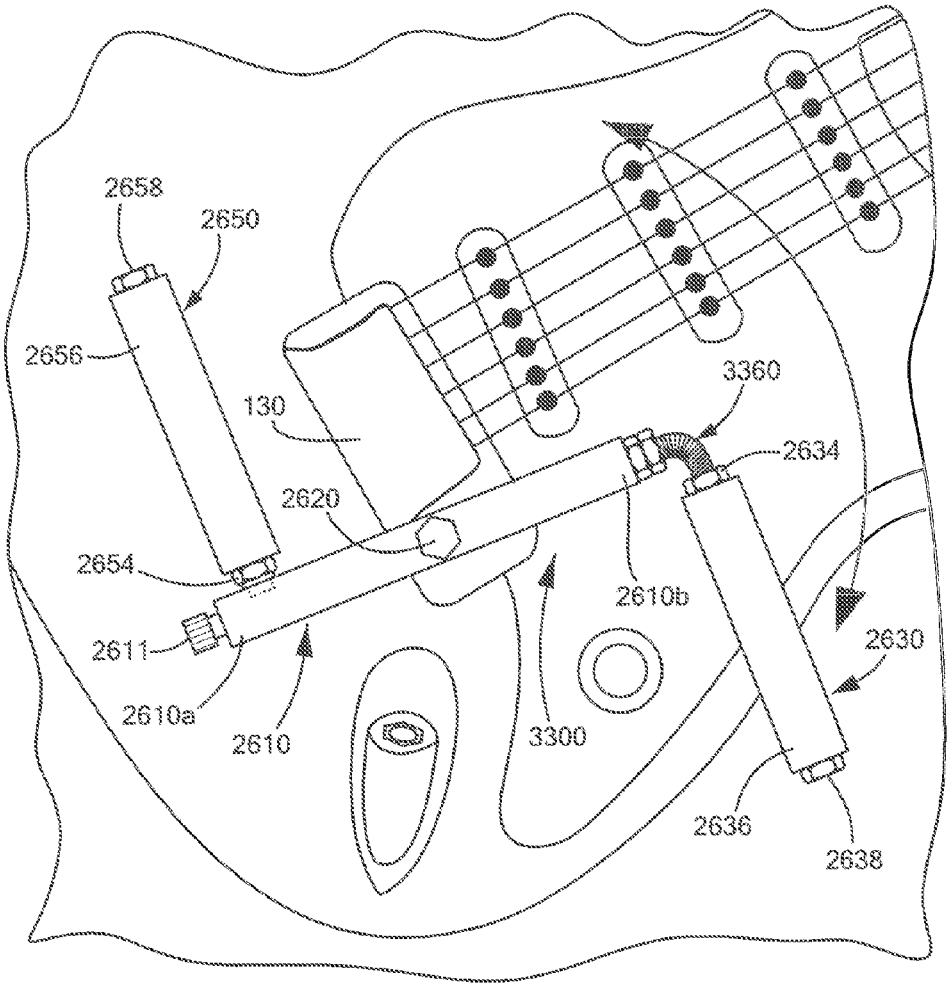
Figure 35:
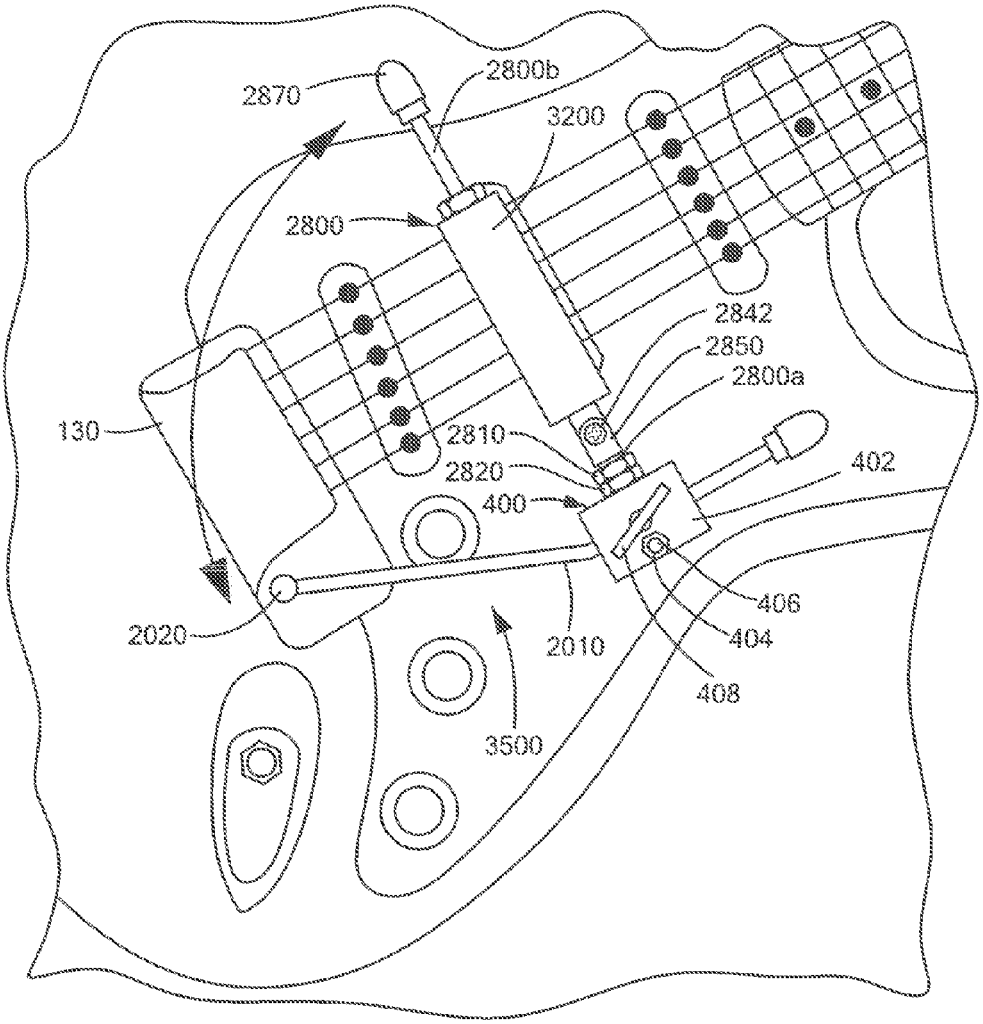
Figure 36:
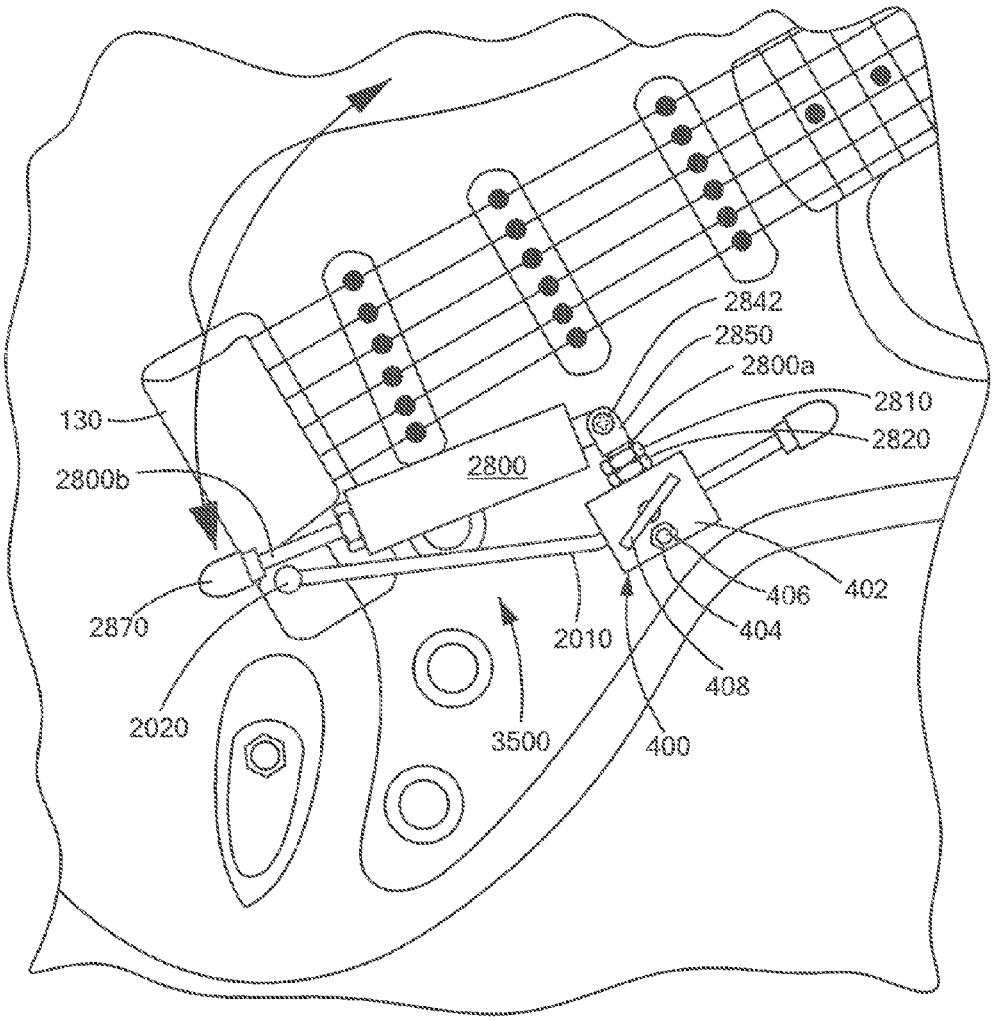
Figure 37:
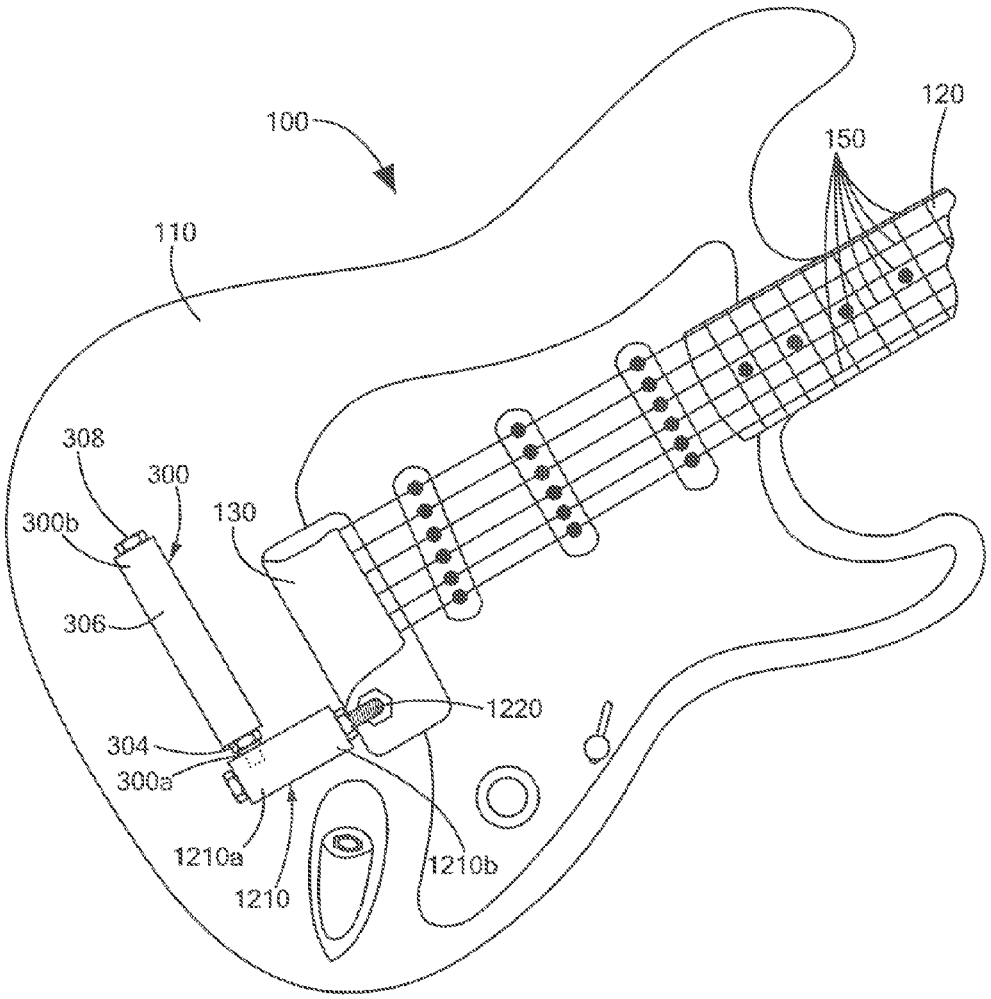
Figure 38:
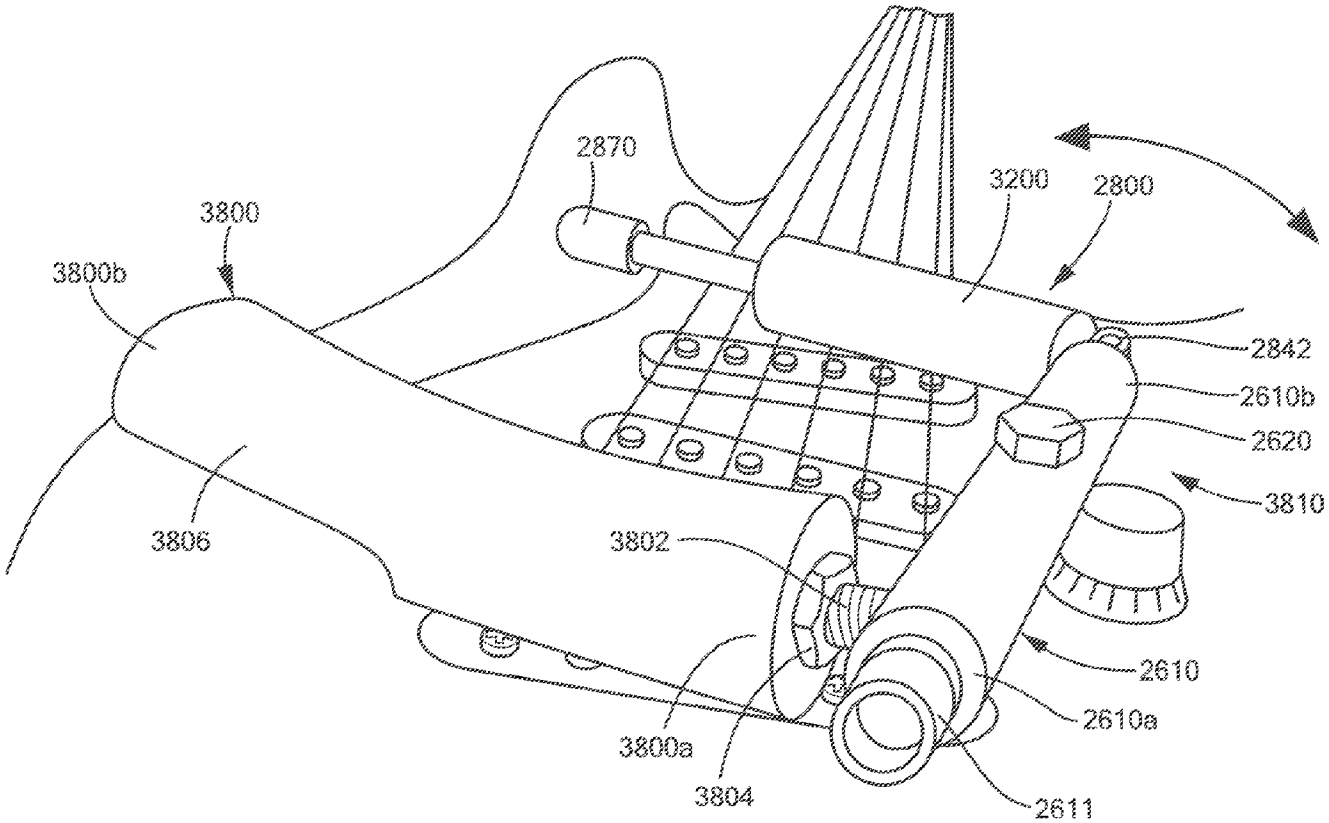
Figure 39:
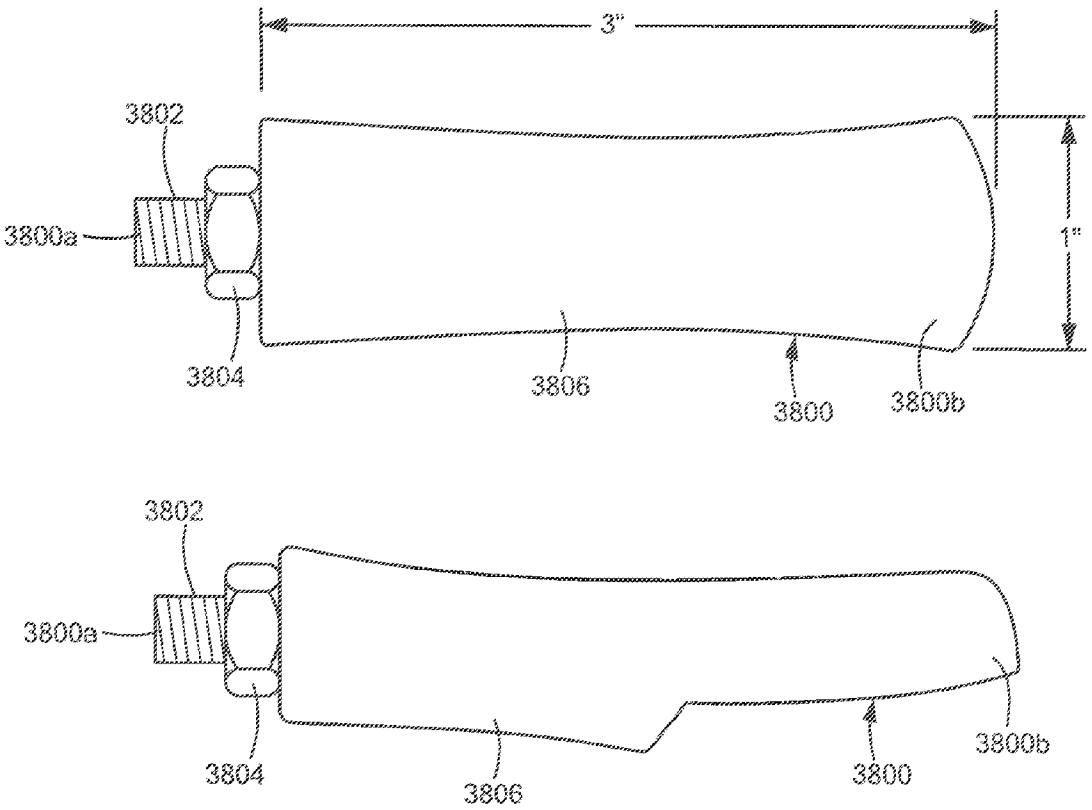

FIB. 26 is a pictorial showing a side perspective view of another example assembly coupled to a guitar similar to the example guitar of FIG. 1 in one example arrangement;

FIG. 27 is a pictorial showing a top perspective view of the example assembly of FIG. 26 coupled to a guitar similar to the example guitar of FIG. 1 in another example arrangement;

FIG. 28 is a pictorial showing another example elongated member of an example assembly for attachment to a guitar;

FIG. 29 is a pictorial showing a side perspective view of the example elongated member of FIG. 28A;

FIG. 30 is a pictorial showing a top perspective view of an example assembly including the example elongated member of FIG. 28A, the example assembly coupled to a guitar similar to the example guitar of FIG. 1 in one example arrangement;

FIG. 31 is a pictorial showing another top perspective view of the example assembly of FIG. 30 coupled to a guitar similar to the example guitar of FIG. 1 in another example arrangement;

FIG. 32 is a pictorial showing a top perspective view of another example assembly coupled to a guitar similar to the example guitar of FIG. 1;

FIG. 33 is a pictorial showing a top perspective view of another example assembly coupled to a guitar similar to the example guitar of FIG. 1 in one example arrangement;

FIG. 34 is a pictorial showing another top perspective view of the example assembly of FIG. 33 coupled to a guitar similar to the example guitar of FIG. 1 in another example arrangement;

FIG. 35 is a pictorial showing a top perspective view of another example assembly coupled to a guitar similar to the example guitar of FIG. 1 in one example arrangement;

FIG. 36 is a pictorial showing another top perspective view of the example assembly of FIG. 35 coupled to a guitar similar to the example guitar of FIG. 1 in another example arrangement;

FIG. 37 is a pictorial showing a top perspective view of another example assembly coupled to a guitar similar to the example guitar of FIG. 1 in one example arrangement;

FIG. 38 is a pictorial showing a front perspective view of another example assembly coupled to a guitar similar to the example guitar of FIG. 1 in one example arrangement; and FIG. 39 is a pictorial showing perspective views of an example elongated member of the example assembly of FIG. 38.

DETAILED DESCRIPTION

The features and other details of the disclosure will now be more particularly described. It will be understood that the specific embodiments described herein are shown by way of illustration and not as limitations of the broad concepts herein. Accordingly, features of the subject matter described herein can be employed in various embodiments without departing from the scope of the concepts herein. Embodiments of the present disclosure and associated advantages may be best understood by referring to the drawings, where like numerals are used for like and corresponding parts throughout the various views.

Definitions

For convenience, certain introductory concepts and terms used in the specification are collected here.

As used herein, the term "clamp" is used to describe a material, device, and/or coupling structure (electrical, mechanical, electro-mechanical, or otherwise) for coupling two or more objects (e.g., elongated members) together. A clamp may be provided as part of a hinged structure.

As used herein, the term. "elongated member" is used to describe a single piece of material or a combination of pieces coupled together, and having an associated length and width, with the length of the single piece of material or the combination of pieces taken together having a length dimension which is substantially greater than a width dimensions. It should be understood that a cross section taken in a direction perpendicular to the length dimension can have any shape, including, but not limited to, a round shape, an oval shape, a square shape, any other polygonal shape, or any other smooth shape.

Some examples shown and describe herein have elongated members with a length dimension of about three inches and a width dimension of about 0.56 inches. However, in other embodiments, other dimensions can be used, for example, a length dimension in a range of about 1.5 inches to about six inches, and a width dimension in a range of about 0.25 inches to about two inches.

As used herein, the term "hinged structure" is used to describe a device and/or coupling structure (electrical, mechanical, electro-mechanical, or otherwise) for coupling two or more objects (e.g., elongated members) together, the hinged structure providing for pivoting of the objects relative to each other about at least one axis. A hinged structure may include or otherwise be coupled to a clamp.

As used herein, the term "region" is used to describe a point or an area on a surface of an object, e.g., an elongated member, or a point or an area inside a volume of an object.

As used herein, the term "rotatable structure" is used to describe a structure that is rotatable about at least one axis.

While assemblies for attachment to a guitar including first, second, third and/or fourth elongated members are described in several examples below, first, second, third and/or fourth elongated members are discussed to promote simplicity, clarity and understanding in the drawings as well as in the written description of the broad concepts, systems, and techniques herein and is not intended to be, and should not be construed, as limiting. The concepts, systems, and techniques disclosed herein may, of course, be implemented using more than four elongated members, or fewer than four elongated members.

Additionally, it should be appreciated that elements shown in the figures are not necessarily drawn to scale. For example, the dimensions of some elements may be exaggerated relative to other elements for clarity.

Referring now to FIG. 1, an example guitar 100 includes a body 110, a neck 120, a bridge assembly (or "bridge") 130, and a conventional tremolo bar 140. The guitar 100 also includes a plurality of strings 150 having a first end coupled to the bridge 130 and a second end coupled to the neck 120. In one aspect the tremolo bar 140 is coupled to the bridge 130 at a coupling point 105 and can be capable of pivoting in a clockwise or counterclockwise direction around the coupling point 105 with respect to the body 110 of the guitar 100 through a coupling means. In another aspect, the tremolo bar 140 is capable of being pushed towards the body 110 of the guitar 100 by a user with a force F (into the page). In "floating bridge" arrangements, as can be found on typically Stratocaster style guitars, the tremolo bar 140 is also capable of being pulled away from the body 110 of the guitar 100 in some embodiments.

In one embodiment, when the tremolo bar 140 is pushed towards the body 110 of the guitar 100 with the force F, a pitch of sounds produced by the guitar 100 is lowered. In one aspect this is due to a tension of the strings 150 being decreased.

In this illustrated embodiment, the tremolo bar 140 is shown to have a bend (but may be straight) and having a substantially cylindrical surface. The tremolo bar 140 is of a type that can be typically found on a Stratocaster style guitar and is referred to herein as a Stratocaster style tremolo bar.

In normal use, the tremolo bar 140 does not pass over the strings 150, but can be pivoted about the coupling point 105.

When operated by a person, the person generally must move his or her hand from the plurality of strings 150 in order to access the tremolo bar 140 with the same hand. Thus, the person may have great difficulty using the strings at the same time that the tremolo bar 140 is being operated.

Figure 2:
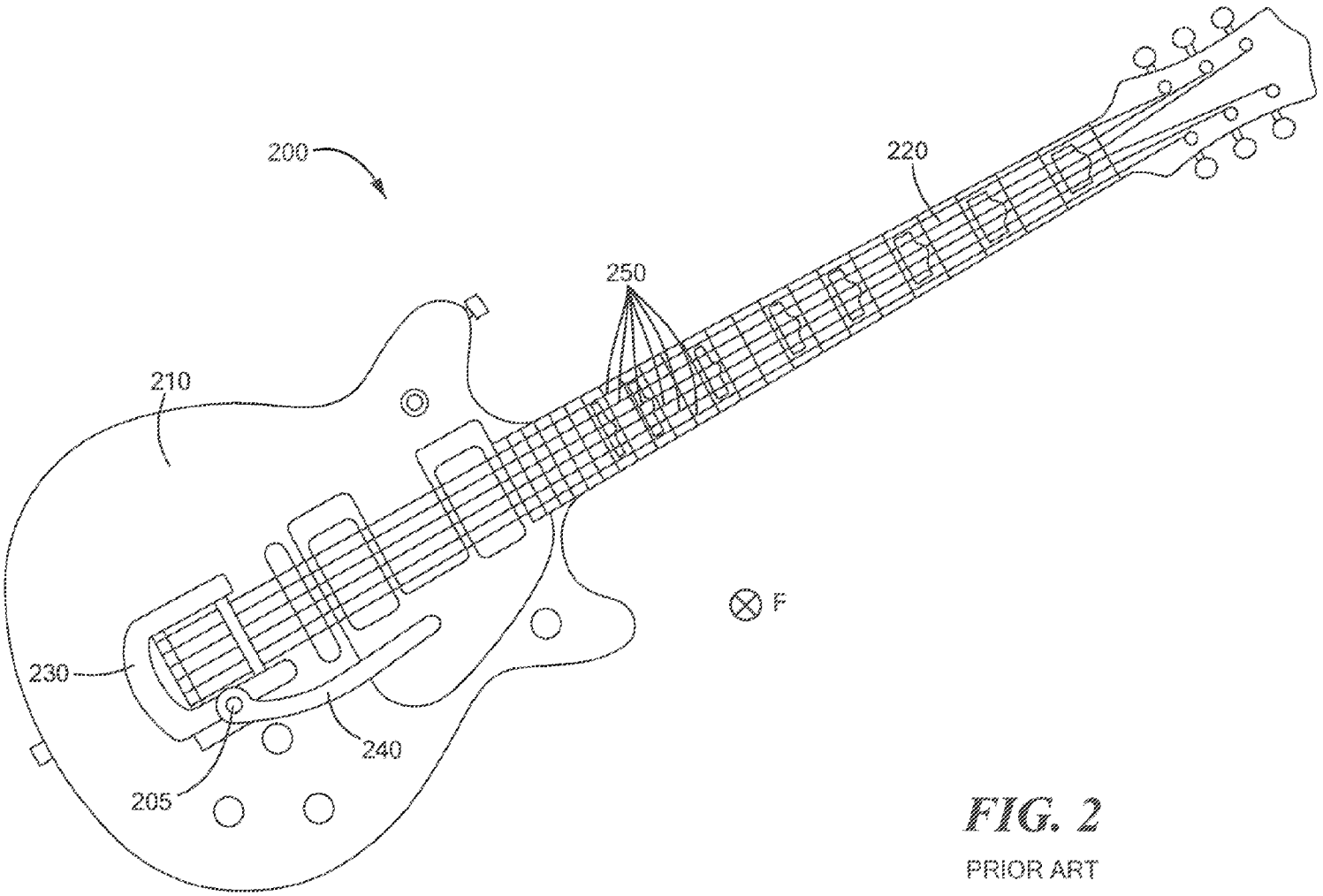
FIG. 2 PRIOR ART
FIG. 2 is a pictorial showing another example guitar with another conventional tremolo bar.

Referring now to FIG. 2, another example guitar 200 includes a body 210, a neck 220, a bridge assembly (or "bridge") 230, and another conventional tremolo bar 240. The guitar 200 also includes a plurality of strings 250 having a first end coupled to the bridge 230 and a second end coupled to the neck 220. In one aspect, the tremolo bar 240 is coupled and functions in a substantially similar manner as tremolo bar 140 of FIG. 1.

In this illustrated embodiment, the tremolo bar 240 is shown as being curved and having a substantially flat surface. The tremolo bar 240, which may also be substantially cylindrically shaped in some embodiments, is of a type that can be typically found on a Bigsby® style guitar and is referred to herein as a Bigsby® style tremolo bar.

While bridges described below can be conventional mechanical bridges, in other embodiments, the bridges described below can be electronic bridges having electronics coupled thereto to generate an electronic function (e.g., including, but not limited to, vibrato and echo functions).

Referring now to FIGS. 3-7, an elongated member 300 of an assembly (e.g., assembly 800 of FIG. 8, as discussed below) for attachment to a guitar, can be the same as or similar to the guitar 200 of FIG. 2 (hut could also be the same as or similar to the guitar 100 of FIG. 1). The elongated member 300 can include first and second ends 300*a*, 300*b*, respectively, arranged along a major axis of the first elongate member 300. The elongated member 300 can include an elongated member engagement mechanism 302 and a tube 306. The elongated member engagement mechanism 302 (e.g., a male threaded rod) has first and second opposing ends arranged along a major axis of the elongated member engagement mechanism 302. The tube 306, which similarly has first and second opposing ends arranged along a major axis of the tube 306, has a cavity configured to receive the elongated member engagement mechanism 302. The tube 306 can, for example, be a cylindrically shaped piece of stock (e.g., metal, plastic, etc.) having an associated length and the first and seconds ends have an associated diameter. In one embodiment, the associated diameter may be in a range of about 0.25 inches to about two inches. In a preferred embodiment, the diameter is about 0.56 inches. Additionally, in one embodiment the tube 306 has a compliant (or soft) surface that is responsive to pressure. In one embodiment, the associated diameter (e.g., 0.56 inches) and surface characteristics (e.g., compliant surface) are chosen for comfort of an anticipated user and for ease of use of the assembly on which the elongated member 300 is provided.

In the illustrated embodiment, the elongated member 300 also includes fastening means (e.g., nuts 304, 308) at each end of the tube 306, the fastening means configured to secure the 306 to the elongated member engagement mechanism 302. In some embodiments, the fastening means comprises a through-hole coupling means (e.g., a hole or a female threaded hole) for coupling to the elongated member engagement mechanism 302. In one embodiment, the elongated member 300 further includes a cap (not shown) disposal over nut 308 and select portions of the second end of the rod 306 for comfort and/or for a grip.

A clamping means (or clamp) 400 is indicated as separate from the elongated member 300 in the example embodiment shown but may be part of the elongated member 300 in some embodiments. The clamp 400 is coupled to receive the first end 300*a* of the elongated member 300 (i.e., the first end of the elongated member engagement mechanism 302). In the illustrated embodiment, the first end 300*a* of the elongated member 300 may be received by the clamp 400, for example, by threading the first end 300*a* of the elongated member 300 into a select portion (e.g., a female threaded portion) of the clamp 400. Additionally, in one embodiment, the first end 300*a* of the elongated member 300 may be received by welding, gluing, snapping or otherwise fastening the first end 300*a* of the elongated member 300 to a select portion of the clamp 400. In the illustrated embodiment, the clamp 400 has a clamping structure 420 (e.g., first and second plates 402*a*, 402*b* and cavity 403 shown in FIG. 4, for example) and an elongated member attachment mechanism 408 (e.g., thumb screw). The clamp 400 is operable to couple the elongated member 300 to another elongated member (e.g., first elongated member 810 of FIG. 8, as described below). Additionally, in the illustrated embodiment, the clamp 400 has a tightening mechanism (e.g., nut-and-bolt 404, 406 shown in FIG. 4, for example) for preventing slippage of the other elongated member relative to the clamp 400. The tightening mechanism may also prevent the clamping structure 420 (e.g., first and second plates 402*a*, 402*b* and cavity 403 shown in FIG. 4, for example) from spreading apart. It should be appreciated that the clamp 400 shown in FIGS. 3-7 and figures below is one example clamp and other clamps or attachment mechanisms may also be found suitable for performing one or more functions of the clamp 400.

In accordance with one aspect of the concepts, systems, and techniques herein, when the elongated member 300 is provided as part of an assembly (e.g., 800 of FIG. 8, as described below), a multi-mode tremolo bar is provided. In particular, a user can change a pitch of sounds produced by a guitar (e.g., 100 of FIG. 1 or 200 of FIG. 2) by using the assembly in a conventional manner (i.e., push select portions of the assembly with his or her hand towards the body of the guitar) in a first mode. However, the user can also use the assembly in another manner. Namely, the user can push on the elongated member 300 of the assembly with a portion of his or her forearm (e.g., a portion of the inner forearm near the wrist up to and including the heel of the hand), in which manner, the user does not need to remove his or her hand from the strings of the guitar. This mode of operation will become clearer from figures below.

Another mode of operation is described below in conjunction with other figures to use a portion of his or her forearm further from the wrist.

Figure 3:
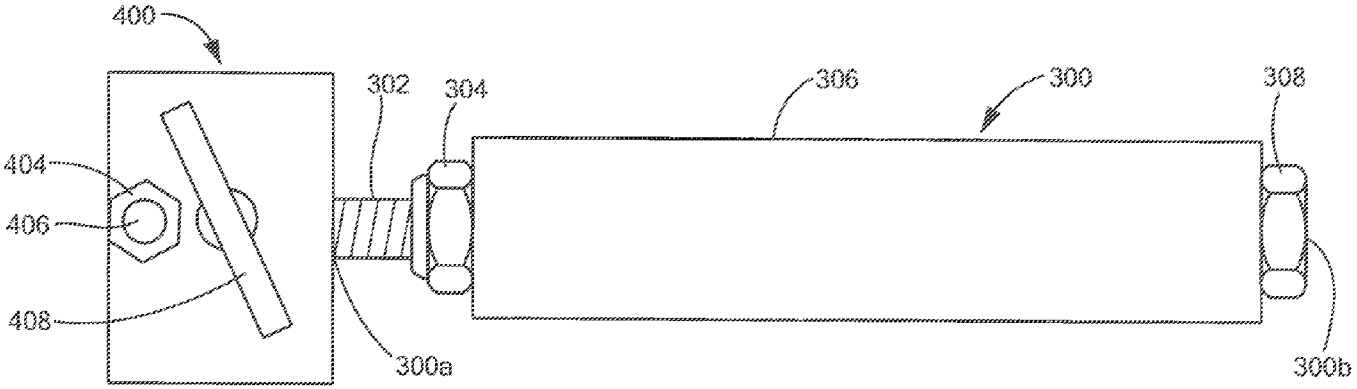
FIG. 3 is a pictorial showing an example elongated member of an example assembly having a clamp for attachment to a guitar.
Figure 4:
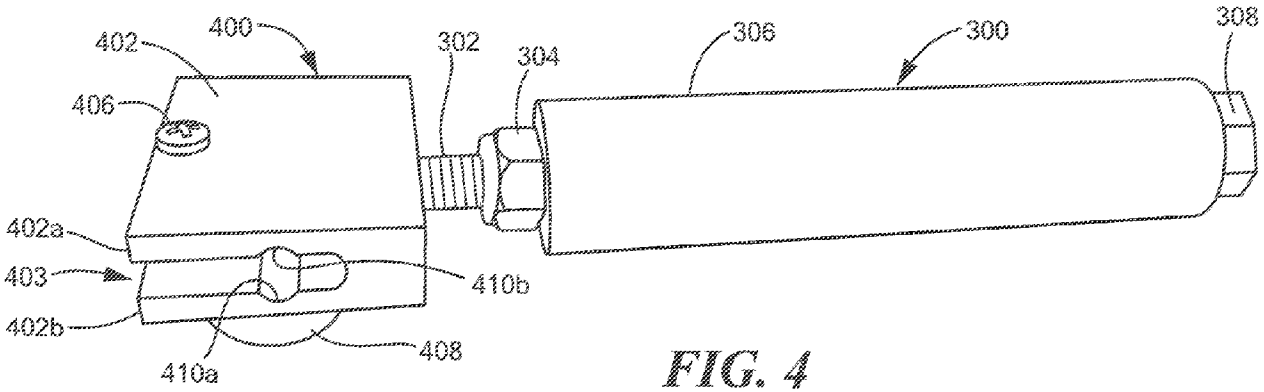
FIG. 4 is a pictorial showing a bottom perspective view of the example elongated member of FIG. 3.

Referring now to FIG. 4, in which like elements of FIG. 3 are shown having like reference designations, a bottom perspective view of elongated member 300 and clamp 400 is shown. The clamping structure 402 of the clamp 400 is shown comprising first and second plates 402*a*, 402*b* and a cavity 403 for insertion of an elongated member (e.g., 810, shown in FIG. 8) which can be the same as or similar to tremolo bar 240 of FIG. 2 (or the tremolo bar 140 of FIG. 1). In one embodiment, each of the first and second plates 402*a*, 402*b* has four sides and substantially equal and opposing surfaces and the first and second plates 402*a*, 402*b* are coupled together at a surface coupled to the elongated member engagement mechanism 302 of elongated member 300. In another embodiment, at least one of the first and second plates 402*a*, 402*b* has one or more surface features 410*a*, 410*b* shaped (or notched) at inside surfaces of one or more of the plates 402*a*, 402*b* to receive an elongated member having a substantially cylindrical, hexagonal, etc. shape. In one embodiment, as shown, the surface features 401*a*, 410*b* on the first and second plates 402*a*, 402*b* may include substantially equal and opposing half-cylindrical surfaces or slots with cylindrical diameters particularly suitable for attachment to the tremolo bar 140 of FIG. 1.

In some embodiments, the clamping structure 402 is a single piece of stock (e.g., metal, plastic) having the cavity 403 for insertion of an elongated member. Also, the clamp 400 may have a compliant (or soft) material disposed over one or more surfaces of the clamp 400, e.g., as may be suitable for a grip or protectant material for the clamp 400 or the guitar on which an assembly including the clamp 400 is disposed.

Figure 5:
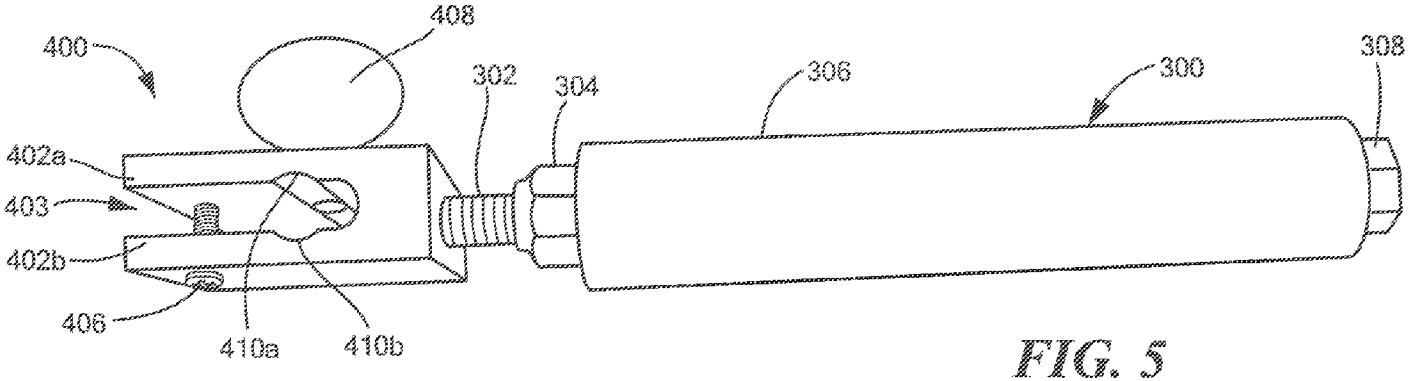
FIG. 5 is a pictorial showing a side perspective view of the example elongated member of FIG. 3.

Referring now to FIG. 5, in which like elements of FIG. 3 are shown having like reference designations, a side perspective view of elongated member 300 is shown.

Figure 6:
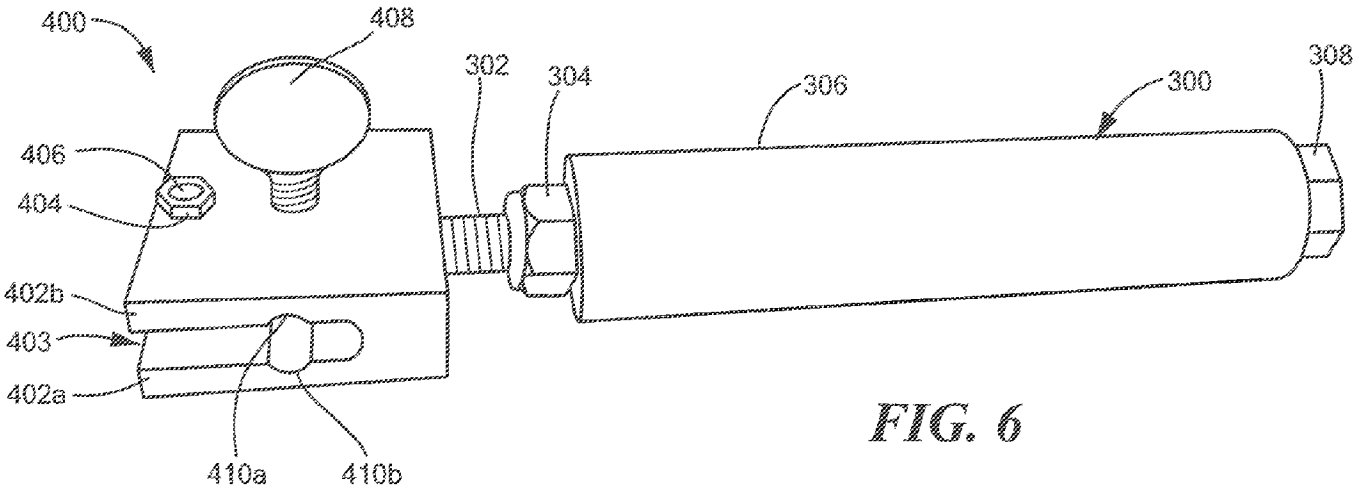
FIG. 6 is a pictorial showing another side perspective view of the example elongated member of FIG. 3.

Referring now to FIG. 6, in which like elements of FIG. 3 are shown having like reference designations, another side perspective view of elongated member 300 is shown.

Figure 7:
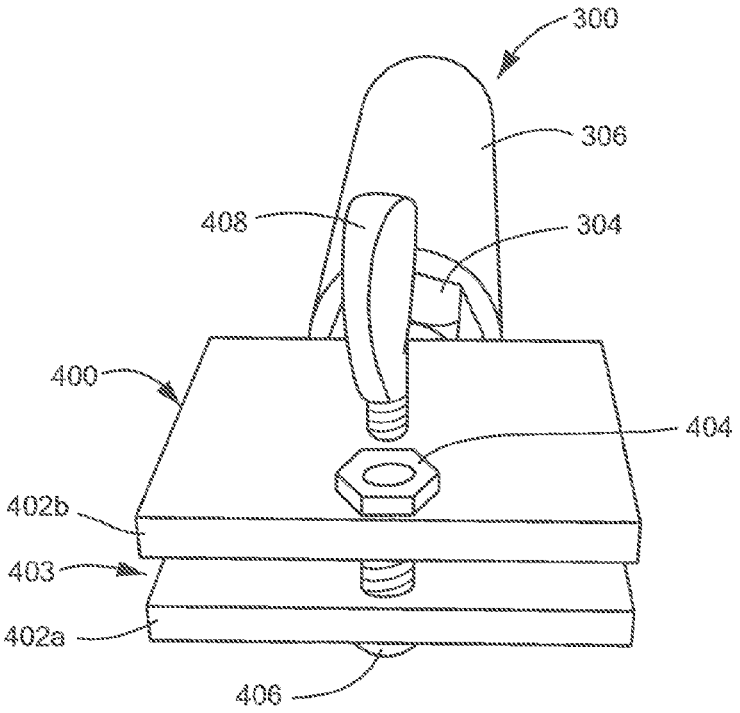
FIG. 7 is a pictorial showing a front perspective view of the example elongated member of FIG. 3.

Referring now to FIG. 7, in which like elements of FIG. 3 are shown having like reference designations, a front perspective view of elongated member 300 is shown.

Clamping by the 400 clamp is further described in figures below.

Figure 8:
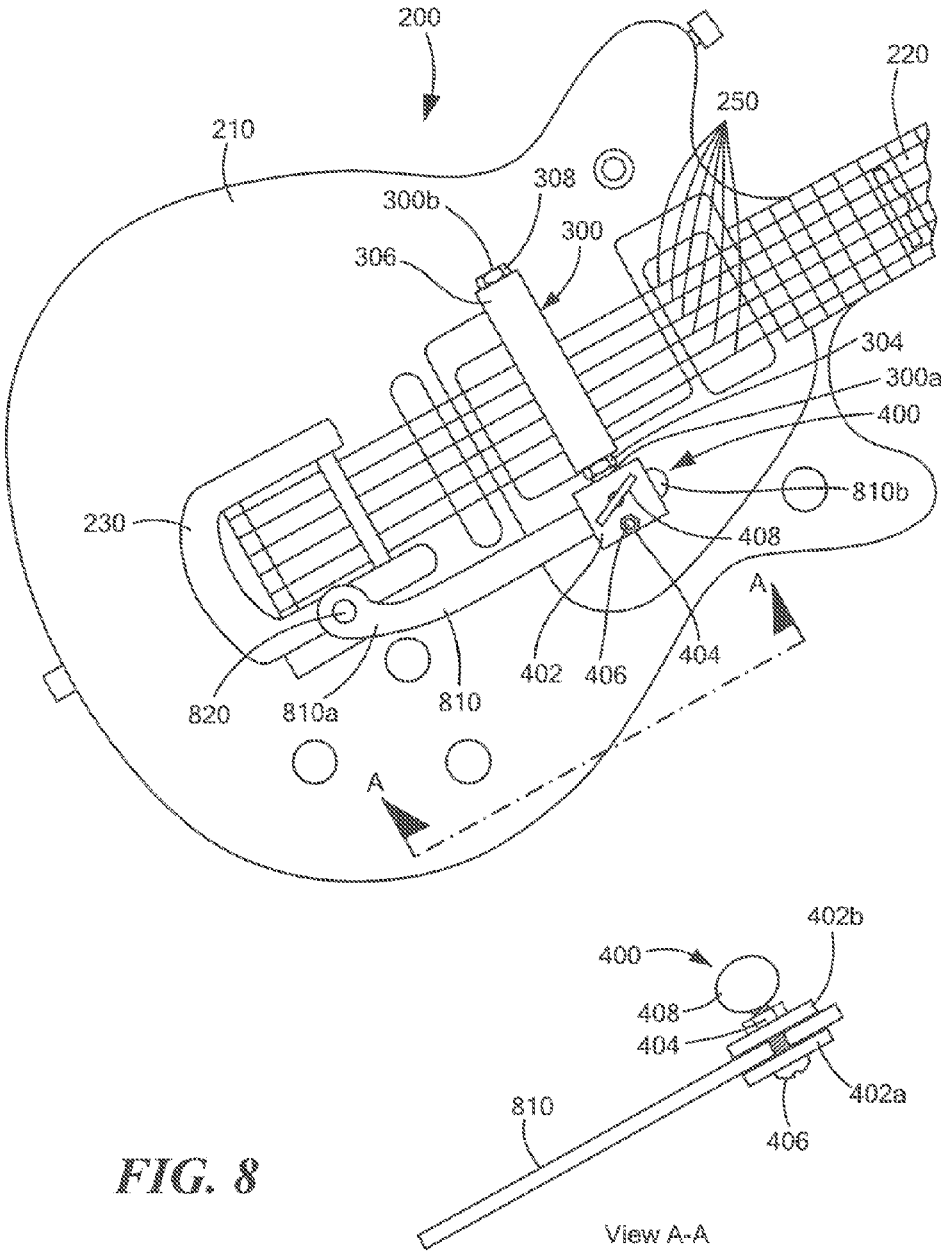
FIG. 8 is a pictorial showing a top perspective view of an example assembly including the example elongated member of FIG. 3, the example assembly coupled to a guitar similar to the example guitar of FIG. 2 in one example arrangement.

Referring now to FIG. 8, in which like elements of FIGS. 2 and 3 are shown having like reference designations, a top perspective view of an assembly coupled to a Bigsby® style guitar (e.g., guitar 200 of FIG. 2) is shown. The assembly includes a first elongated member 810, a bridge engagement mechanism 820, the elongated member 300 (also sometimes referred to herein as a "second elongated member"), and the clamp 400. The first elongated member 810, which may be the same as or similar to a tremolo bar of a Bigsby® style guitar (e.g., tremolo bar 240 of guitar 200), has first and second opposing ends, 810*a*, 810*b*, respectively, arranged along a major axis of the first elongated member 810. The first end 810*a* of first elongated member 810 is coupled to the bridge engagement mechanism 820 and the second end 810*b* of the first elongated member 810 extends beyond the bridge 230 of the guitar 200 in a direction of the neck 220. The bridge engagement mechanism 820 is configured to couple to the bridge 230.

The clamp 400, which is coupled to receive the first end 300*a* of the second elongated member 300 and is removably operable to couple to the first elongated member 810, is coupled between the first end 300*a* of the second elongated member 300 and the first elongated member 810. In the illustrated embodiment, the second elongated member 300 is coupled proximate to the second end 810*b* of the first elongated member 810.

In one aspect, the second elongated member 300 is coupled to the first elongated member 810 such that a substantially L-shaped assembly can be formed. However, in some arrangements, it may be preferred to attach the second elongated member 300 to the first elongated member 810 at a position which leaves a small portion of the second end 810*b* of the first elongated member 810 exposed as shown, so that a user can actuate the assembly by way of the first elongated member 810 with his or her hand and actuate the assembly by way of the second elongated member 300 using his or her forearm.

It should be appreciated that the second elongated member 300 passes above ones of the plurality of strings 250 of guitar 200, for example, with a clearance of about 0.5 to about one 1.0 inches.

The clamp 400 can affix the second elongate member 300 to the first elongated member 810.

It should be appreciated that, in operation, a person can access the second elongated member 300 with his or her forearm or wrist to move the first elongated member 810, thereby actuating the tremolo function, while keeping his or her hand at a position to also access the strings 250 at the same time.

Figure 9:
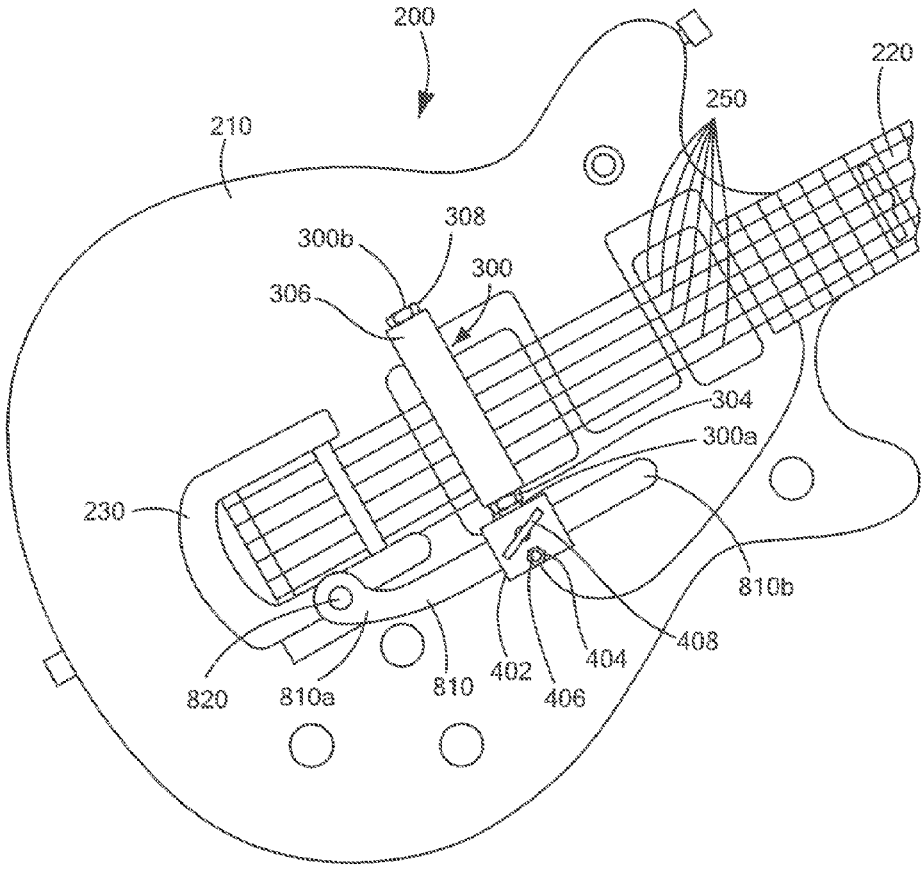
FIG. 9 is a pictorial showing a top perspective view of the example assembly of FIG. 8 coupled to a guitar similar to the example guitar of FIG. 2 in another example arrangement.
Figure 10:
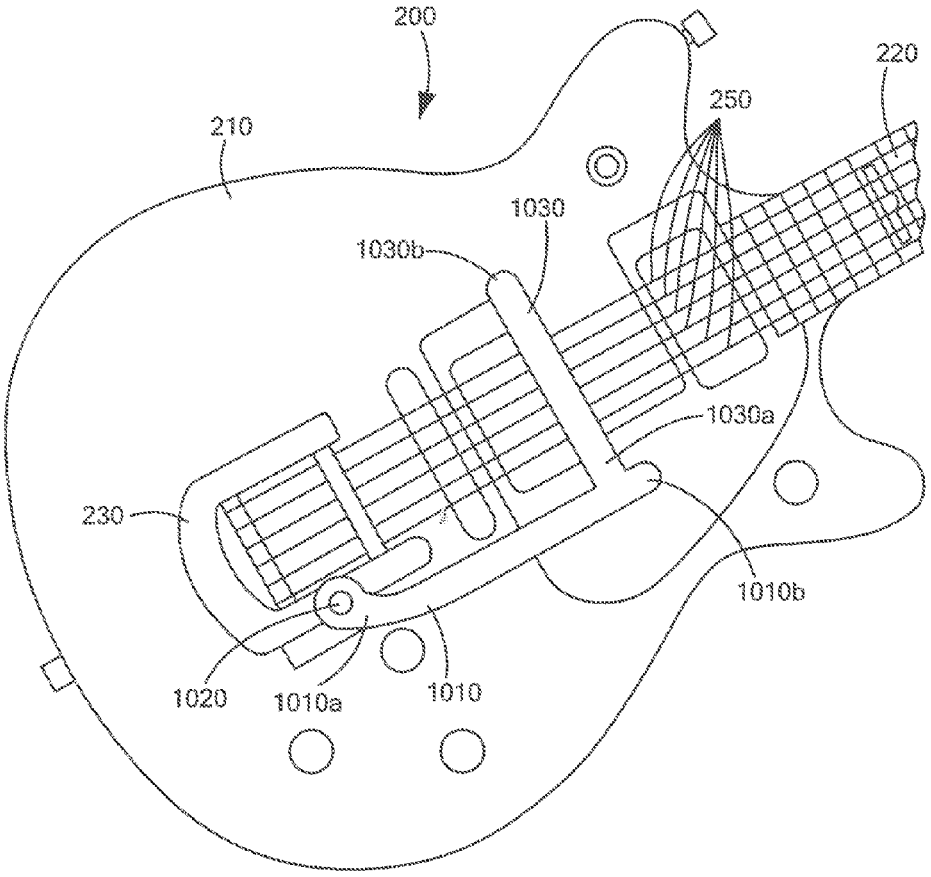
FIG. 10 is a pictorial showing a top perspective view of an example assembly coupled to a guitar similar to the example guitar of FIG. 2.

While it is shown in FIGS. 9 and 10, that the major axis of the second elongated member 300 is approximately perpendicular to the major axis of the first elongated member 810, other angles are possible. In other embodiments, the angle can be any angle within about +/− forty-five degrees of perpendicular.

While the elongated member attachment mechanism 408 (e.g., thumb screw) is shown to be facing upward away from the guitar body, in other embodiments, here and in similar figures below that use the clamp 400, the elongated member attachment mechanism 408 can instead face downward toward the guitar body. Similarly, the tightening mechanism (e.g., nut-and-bolt 404, 406) can be inverted with the nut 404 facing downward toward the guitar body. Further, while elongated member attachment mechanism 408 is shown as a thumb screw in the illustrated embodiments, a thumb screw is an example of an elongated member attachment mechanism 408 and it should be appreciated that other structures and assemblies may also be found suitable.

Referring now to FIG. 9, in which like elements of FIGS. 2 and 8 are shown having like reference designations, a top perspective view of the assembly of FIG. 8 coupled to a Bigsby® style guitar (e.g., guitar 200) in another example arrangement is shown. In the illustrated embodiment, the first end 300*a* of the second elongated member 300 is coupled to the first elongated member 810 at a position approximately equidistant between the first and second ends of the first elongated member 810. In one aspect, the second elongated member 300 is coupled to the first elongated member 810 such that when coupled a substantially T-shaped assembly can be formed.

Referring now to FIG. 10, in which like elements of FIG. 2 are shown having like reference designations, a top perspective view of an assembly coupled to a Bigsby® style guitar (e.g., guitar 200) is shown. Unlike the assemblies of FIGS. 8 and 9 above, the assembly of FIG. 10 can be formed as one piece structure. The assembly includes first and second elongated members 1010, 1030, the first elongated member 1010 having first and second opposing ends 1010*a*, 1010*b*, respectively, arranged along a major axis of the first elongated member 1010, and the second elongated member 1030 having a first region (proximate to a first end 1030*a* of the second elongated member 1030 and a second region, here proximate to a second end 1030*h* of the second elongated member 1030*b*. The first and second regions of the second elongated member 1030 are arranged along a major axis of the second elongated member with the first end 1030*a* of the second elongated member 1030 coupled to the first elongated member 1010.

In some embodiments, the first and second elongated members 1010, 1030 have flat surfaces, are each about 035 inches wide, and are each about 0.125 inches deep. However, other dimensions and surfaces are possible. Also, the first and second elongated members 1010, 1030 can have different dimensions and/or surfaces, e.g., one flat and one cylindrical.

The first end 1010*a* of the first elongated member 1010 can be coupled to a bridge engagement mechanism (e.g., male or female thread) 1020 for coupling the assembly to the bridge 230 of the guitar 200.

In one embodiment, the major axis of the second elongated member 1030 arranged to be within about forty-five degrees of perpendicular to the major axis of the first elongated member 1010. Additionally, in one embodiment, the major axis of the second elongated member 1030 is arranged to be with about 45 degrees of perpendicular to a line parallel to the plurality of strings 250 and a center (between the first and second ends 1030*a*, 1030*h*) of the second elongated member 1030 is disposed along the line parallel to the plurality of strings 250.

In the embodiment shown, the first end 1030*a* of the second elongated member 1030 is positioned proximate to the second end 1010*b* of the first elongated member 1010. In one aspect, such forms a substantially L-shaped assembly. However, as described above, in some arrangements, it may be preferred to retain a small portion of the second end of the first elongated member 1010 forming a tab as shown so that a user can actuate the assembly downward with his or her hand and also actuate the assembly by way of the second elongated member 1030 using his or her forearm.

As illustrated, the assembly of FIG. 10 has similar appearance to the assembly of FIG. 8. In one aspect, the functionality of the assembly of FIG. 10 is substantially the same as or similar to the assembly of FIG. 8.

It should be appreciated that the second elongated member 1030 passes over the plurality of strings 250, for example, with a clearance of about 0.5 inches to about one 1.0 inch.

Figure 11:
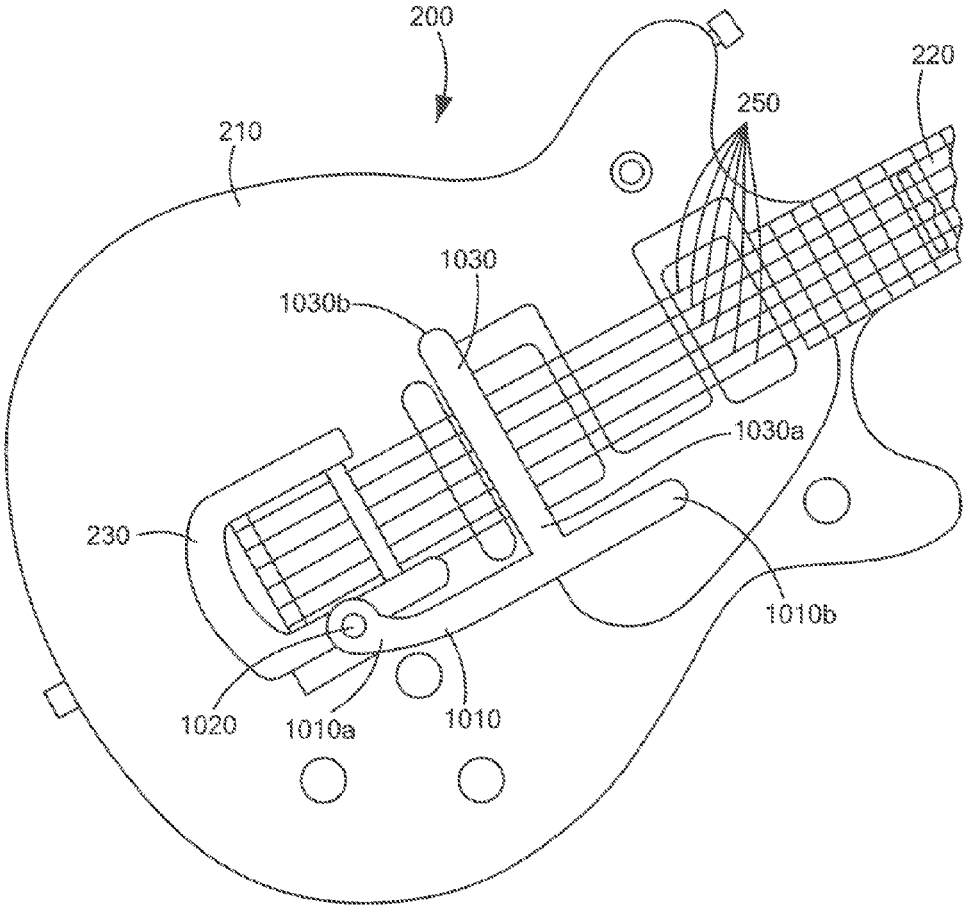
FIG. 11 is a pictorial showing a top perspective view of another example assembly coupled to a guitar similar to the example guitar of FIG. 2.

Referring now to FIG. 11, an assembly similar to the assembly of FIG. 10 is shown. Here, however, a first end of a second elongated member 1030 is positioned more centrally between first and second ends of a first elongated member 1010, as illustrated by the assembly in FIG. 11. In one aspect, such forms a substantially T-shaped assembly. As illustrated, the assembly of FIG. 11 has a similar appearance to the assembly of FIG. 9. In one aspect, the functionality of assembly of FIG. 11 is substantially the same as or similar to the assembly of FIG. 9.

As described above, while it is shown in FIGS. 10 and 11, that the major axis of the second elongated member 1030 is approximately perpendicular to the major axis of the first elongated member 1010, other angles are possible. In other embodiments, the angle can be any angle within about +/− forty-five degrees of perpendicular.

Figure 12:
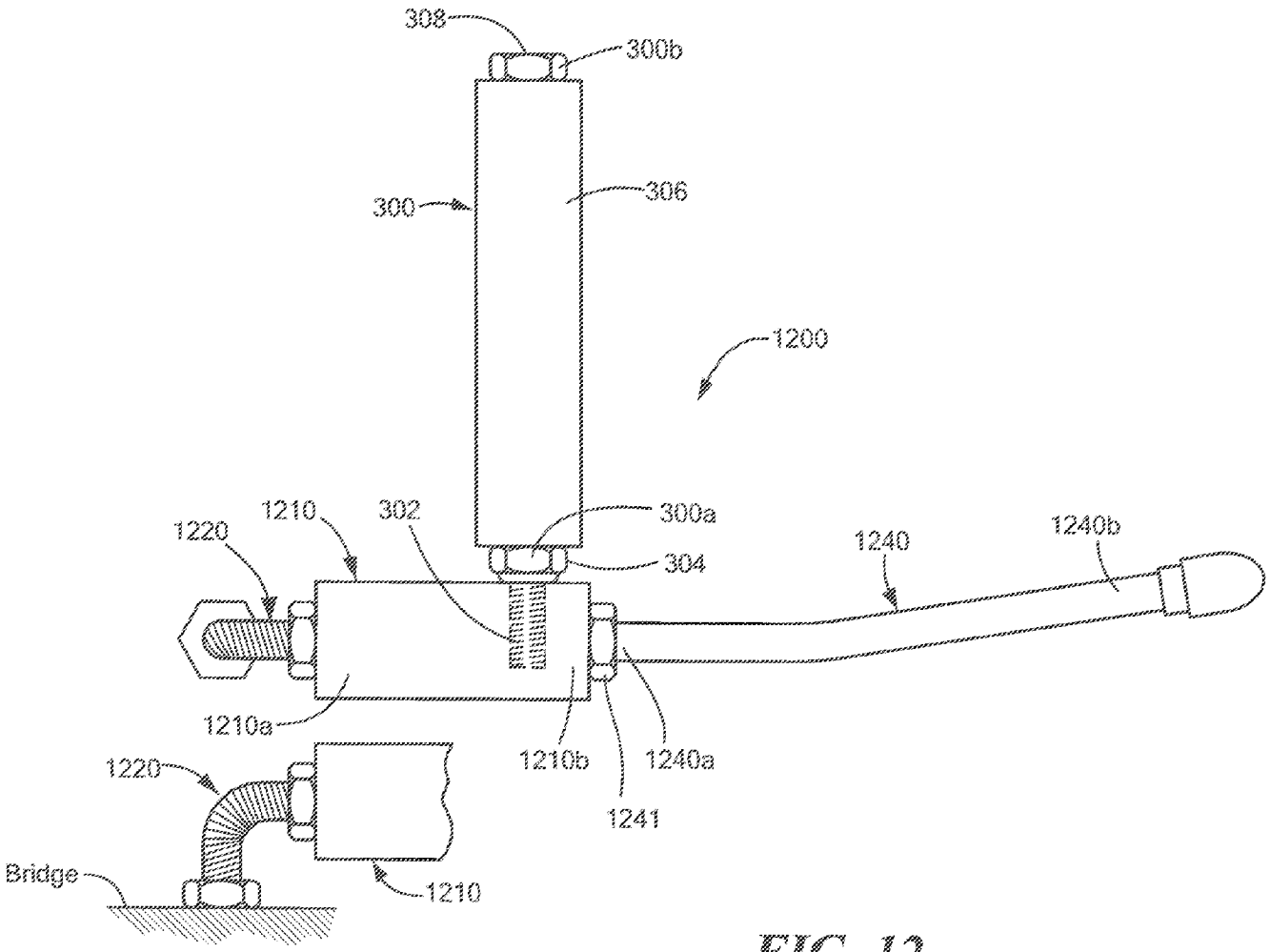
FIG. 12 is a pictorial showing another example assembly for attachment to a guitar.

Referring now to FIG. 12, in which like elements of FIG. 3 are shown having like reference designations, an assembly 1200 for attachment to a guitar, which can be the same as or similar to the guitar 100 of FIG. 1 (but could also be the same as or similar to the guitar 200 of FIG. 2), is shown. The assembly 1200 includes a first elongated member 1210, a bridge engagement mechanism 1220, the elongated member 300 (also sometimes referred to herein as a "second elongated member"), and a third elongated member 1240. The first elongated member 1210, which has first and second opposing ends, 1210*a*, 1210*b*, respectively, arranged along a major axis of the first elongated member 1210, is coupled to each of the bridge engagement mechanism 1220, the second elongated member 300 and the third elongated member 1240.

The bridge engagement mechanism 1220 has a first portion proximate and coupled to the first end 1210*a* of the first elongated member 1210 and a second portion configured to couple a bridge of a guitar (e.g., bridge 130 of guitar 100 of FIG. 1). In one embodiment, at least one of first and second portions of the bridge engagement mechanism 1240 has a through-hole coupling means (e.g., male thread rod) for coupling to the first elongated member 1210 or the bridge. Additionally, the first end 300*a* of the second elongated member 300 (i.e., the first end of the elongated member engagement mechanism 302) is coupled to the first elongated member 1210. In one embodiment, the first end 300*a* of the second elongated member 300 is coupled to the first elongated member 1210 by threading the first end 300*a* of the second elongated member 300 into a select portion (e.g., a female threaded portion) of the first elongated member 1210. Additionally, in one embodiment, when coupled to the first elongated member 1210, the major axis of the second elongated member 300 is rigidly arranged to be within about forty-five degrees of perpendicular to the major axis of the first elongated member 1210 on which it is coupled.

However, while it is shown in FIG. 12 that the major axis of the second elongated member 300 is approximately perpendicular to the major axis of the first elongated member 1010, other angles are possible. In other embodiments, the angle can be any angle within about +/− forty-five degrees of perpendicular.

The third elongated member 1240 has a first region proximate to a first end 1240*a* of the third elongated member 1240 and a second region proximate to a second end of the third elongated member 1240. Similar to the second elongated member 300, the first and second regions of the third elongated member 1240 may be arranged along a major axis of the third elongated member 1240. The first end 1240*a* of the third elongated member 1240, which has at least a fastening means (e.g., nut 1241) in the example embodiment shown, is coupled to the second end 1210*a* of the first elongated member 1210. In some embodiments, the first end 1240*a* of the third elongated member 1240 includes a through-hole coupling means (e.g., male threaded rod) similar to the elongated member engagement mechanism 302 of FIG. 12 for coupling to the first elongated member 1210. Also, in some embodiments the first elongated member 1210 has a cavity or a through-hole coupling means (e.g., female threaded hole) for insertion of the third elongated member 1240.

In one aspect of the concepts, systems, and techniques herein, assembly 1200 provides a multi-mode tremolo bar. In particular, a user can change a pitch of sounds produced by a guitar (e.g., 100 of FIG. 1 or 200 of FIG. 2) by using the first and/or third elongated members 1210, 1240 in a conventional manner (i.e., push the first and/or third elongated members 1210, 1240 with his or her hand towards the body of the guitar) in a first mode. However, the user can also use the assembly 1200 in another manner. Namely, the user can push on the second elongated member 300 of the assembly 1200, once attached to the first elongated member, with a portion of his or her forearm (e.g., a portion of the inner forearm near the wrist up to and including the heel of the hand), in which manner, the user does not need to remove his or her hand from the strings of the guitar. This mode of operation will become clearer from figures below.

Figure 13:
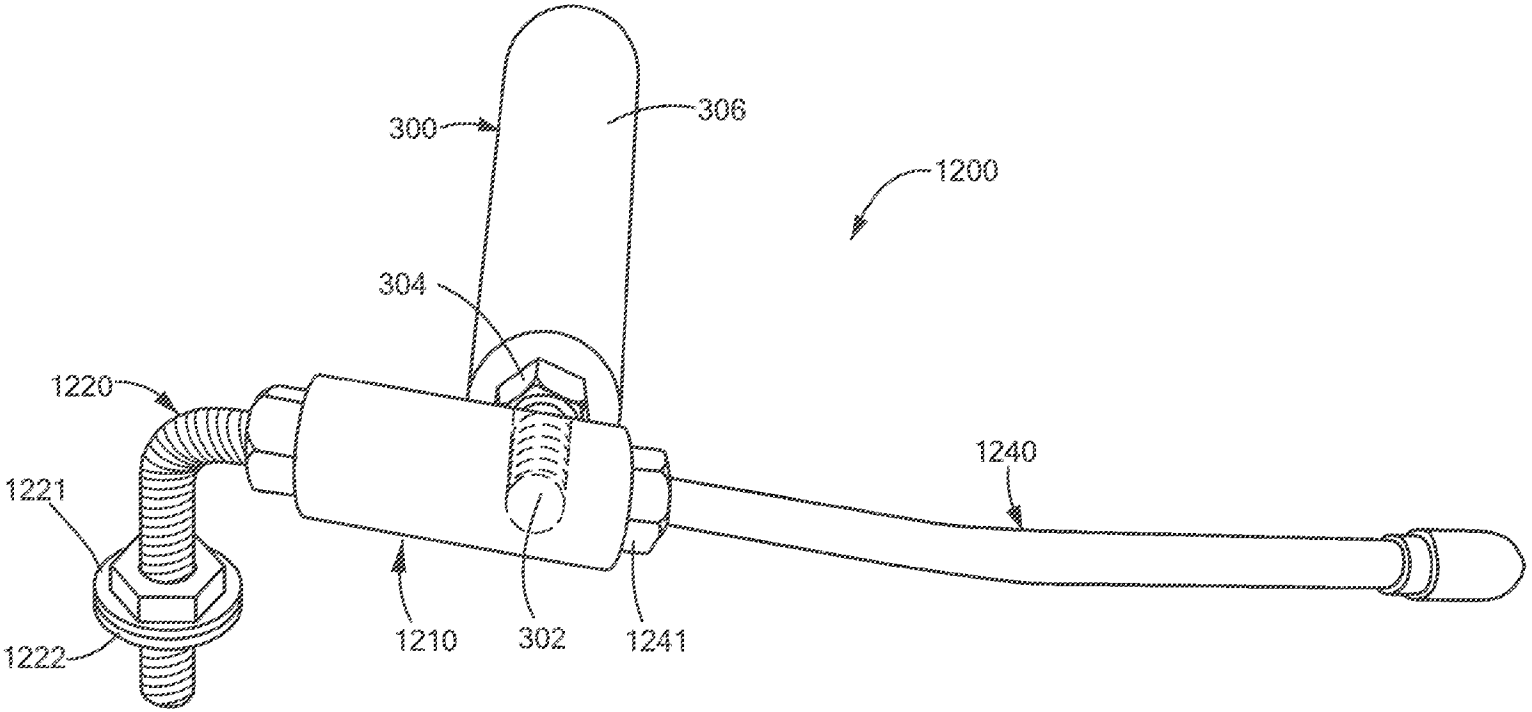
FIG. 13 is a pictorial showing a side perspective view of the example assembly of FIG. 12 in one example arrangement.

Referring now to FIG. 13, in which like elements of FIG. 12 are shown having like reference designations, a side perspective view of assembly 1200 is shown. Here, however, assembly 1200 additionally includes washers 1221, 1222 disposed between a coupling surface on the second portion of the bridge engagement mechanism 1220 and a coupling surface on the bridge of the guitar on which the bridge engagement mechanism 1220 is configured to couple. In one embodiment, at least one of the washers 1221, 1222 has a compliant (or soft) surface as may be suitable for protecting the coupling surface on the bridge. Additionally, in one embodiment, at least one of the washers 1221, 1222 has a rigid surface. A first one of the washers (e.g., washer 1221) may have a rigid surface and a second one of the washers (e.g., washer 1222) may have a compliant surface, with the first one of the washers (e.g., a metal washer) disposed over the second one of the washers (e.g., a rubber washer). Further, in one embodiment, at least one of the washers 1221, 1222 comprises a material that includes rubber (e.g., neoprene), metal, fabric, nylon, leather, and/or a synthetic material. While washers 1221, 1222 are shown, in other embodiments, the washers 1221, 1222 can be replaced with a single washer, still having similar features to couple to the rod 1210. Additionally, while washers are only shown in FIG. 13 (and FIGS. 25-26 below), it is to be appreciated that washers may be provided on any of the bridge engagement mechanisms shown in all figures discussed herein (FIGS. 1-39).

Figure 14:
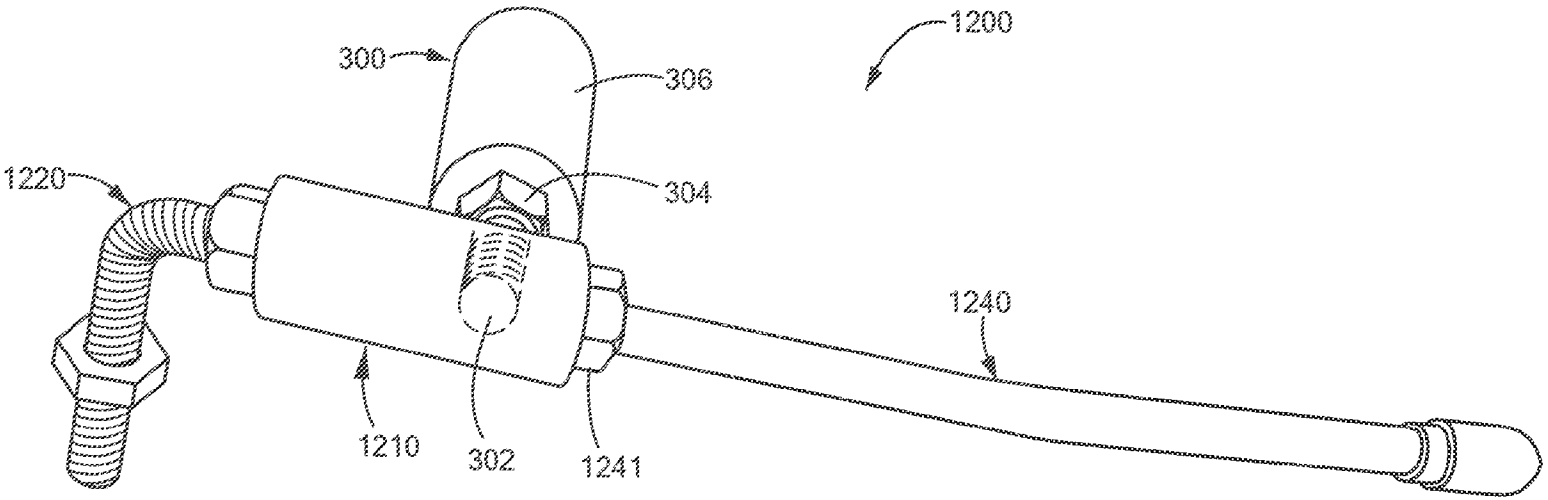
FIG. 14 is a pictorial showing another side perspective view of the example assembly of FIG. 12 in another example arrangement.

Referring now to FIG. 14, in which like elements of FIG. 12 are shown having like reference designations, another side perspective view of assembly 1200 is shown.

Figure 15:
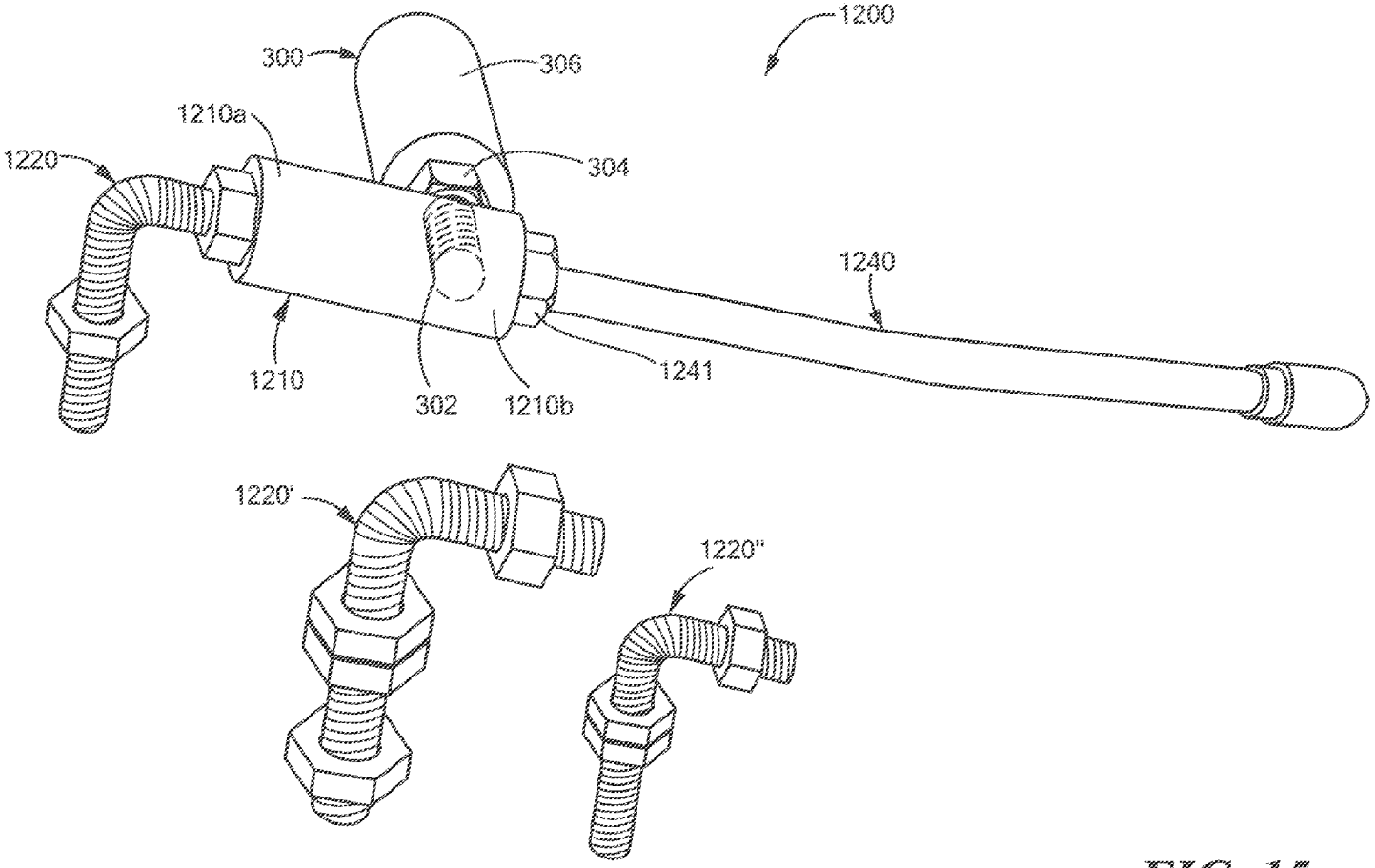
FIG. 15 is a pictorial showing a side perspective view of the example assembly of FIG. 12 and example bridge engagement mechanisms of the example assembly of FIG. 12.

Referring now to FIG. 15, in which like elements of FIG. 12 are shown having like reference designations, a side perspective view of assembly 1200 and example bridge engagement mechanisms of assembly 1200 is shown. In one embodiment, the assembly 1200 is capable of coupling to guitar bridges (e.g., 130 of FIG. 1) having varying coupling means (e.g., male threaded rod, female threaded hole) and diameters by using bridge engagement mechanisms (e.g., threaded rods, which are coupled to the bridge) having varying coupling means (e.g., male thread, female thread or snapped on feature) and diameters, as illustrated by bridge engagement mechanisms 1220, 1220', and 1220". Some example diameters include one-eighth of an inch, one-quarter of an inch, and one-third of an inch. Metric sizes are also possible. The first end 1210*a* of the first elongated member 1210 may be sized and configured to receive each of the bridge engagement mechanisms 1220, 1220', and 1220". The foregoing provides for an assembly 1200 that is capable of being used on a multitude of guitar bridges.

While bridge engagement mechanisms 1220, 1220', and 1220" of FIG. 15 and several figures below are shown having a curved shape, it should be appreciated bridge engagement mechanisms 1220, 1220, and 1220" (and other bridge engagement mechanisms described herein) can also have a shape which is straight (i.e., having no curvature), substantially straight, substantially curved, or any other shape which may be found suitable for coupling an elongated member (e.g., the first elongated member 1210) to the bridge of the guitar. An example straight bridge engagement mechanism is shown in FIG. 26 (e.g., bridge engagement mechanism 2620).

Additionally, while bridge engagement mechanisms 1220, 1220', and 1220" of FIG. 15 and several figures below are shown as being received or coupled at an end of an elongated member (e.g., the first elongated member 1210), in some embodiments bridge engagement mechanisms 1220, 1220', and 1220" (and other bridge engagement mechanisms described herein) are received by a through-hole coupling means (e.g., female threaded hole) in one or more surfaces (e.g., a "top" and a "bottom" surface) of the elongated member (e.g., similar to the through-hole coupling means in elongated member 2610 of FIG. 26). In one embodiment, the through-hole coupling means has a surface which is perpendicular to a length of the elongated member.

It should be appreciated that bridge engagement mechanisms shown above and below (e.g., bridge engagement mechanisms 1220, 1220', and 1220") are example configurations of bridge engagement mechanisms and other configurations having same, similar, or different structures may also be found suitable for coupling an elongated member (i.e., the first elongated member 1210) to the bridge section of the guitar. Similar, the nut and washer configurations shown above and below (e.g., with bridge engagement mechanisms 1220, 1220', and 1220") are example configurations of nut and washer configurations and other configurations having same, similar, or different structures may also be found suitable.

Further, while it is shown in FIG. 15 that the major axis of the second elongated member 300 is approximately perpendicular to the major axis of the first elongated member 1210, other angles are possible. In other embodiments, the angle can be any angle within about +/− forty-five degrees of perpendicular.

Figure 16:
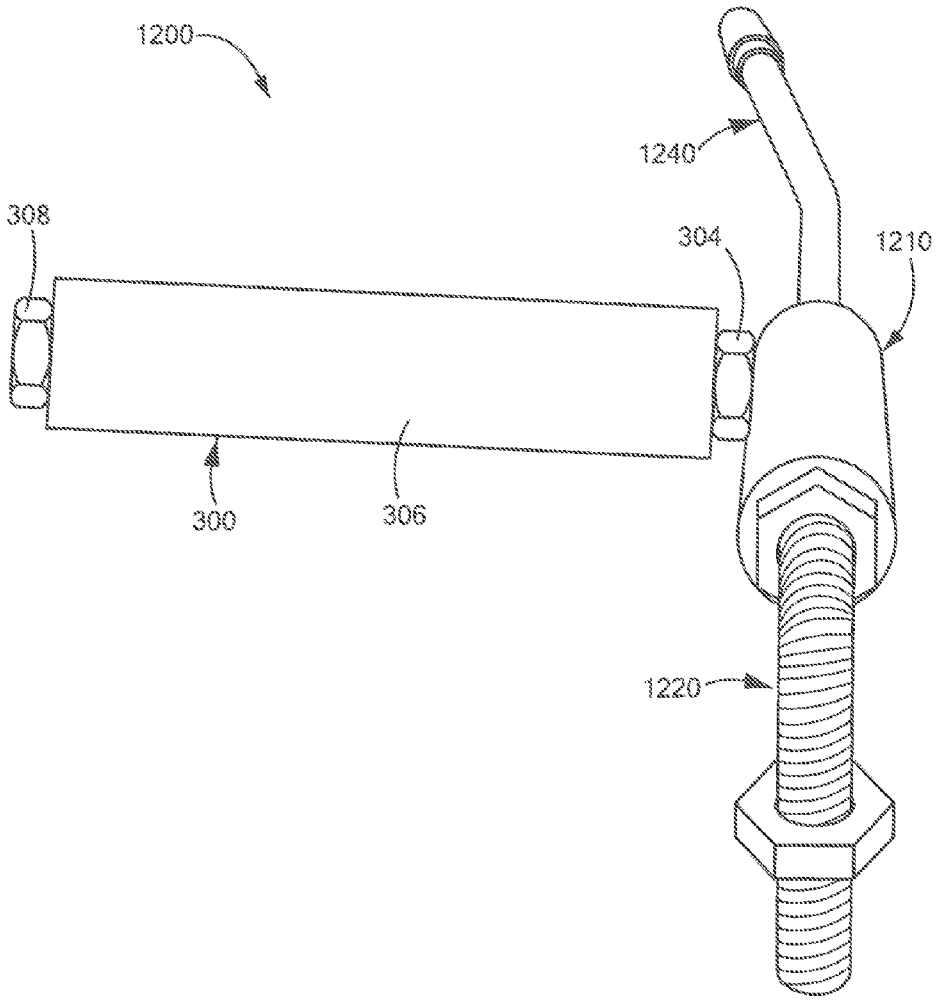
FIG. 16 is a pictorial showing a front perspective view of the example assembly of FIG. 12.

Referring now to FIG. 16, in which like elements of FIG. 12 are shown having like reference designations, a front perspective view of assembly 1200 is shown.

Figure 17:
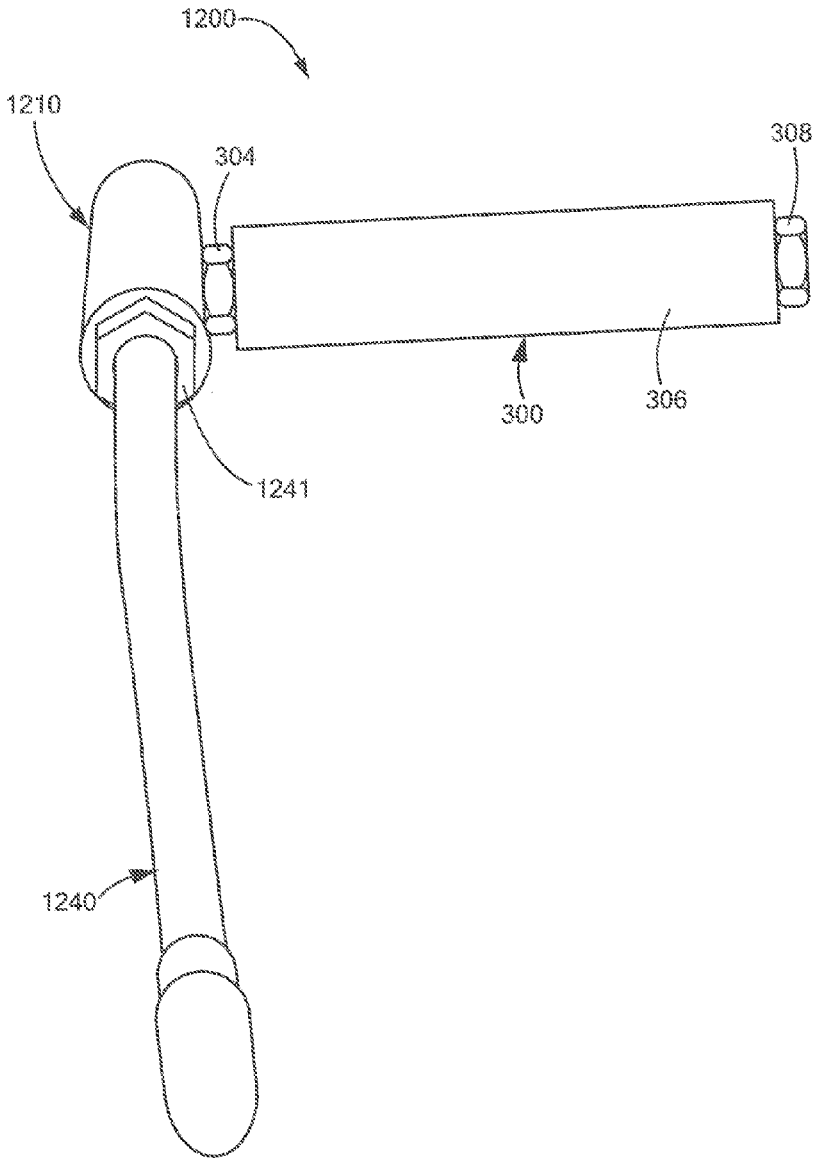
FIG. 17 is a pictorial showing a back perspective view of the example assembly of FIG. 12.

Referring now to FIG. 17, in which like elements of FIG. 12 are shown having like reference designations, a back perspective view of assembly 1200 is shown.

Figure 18:
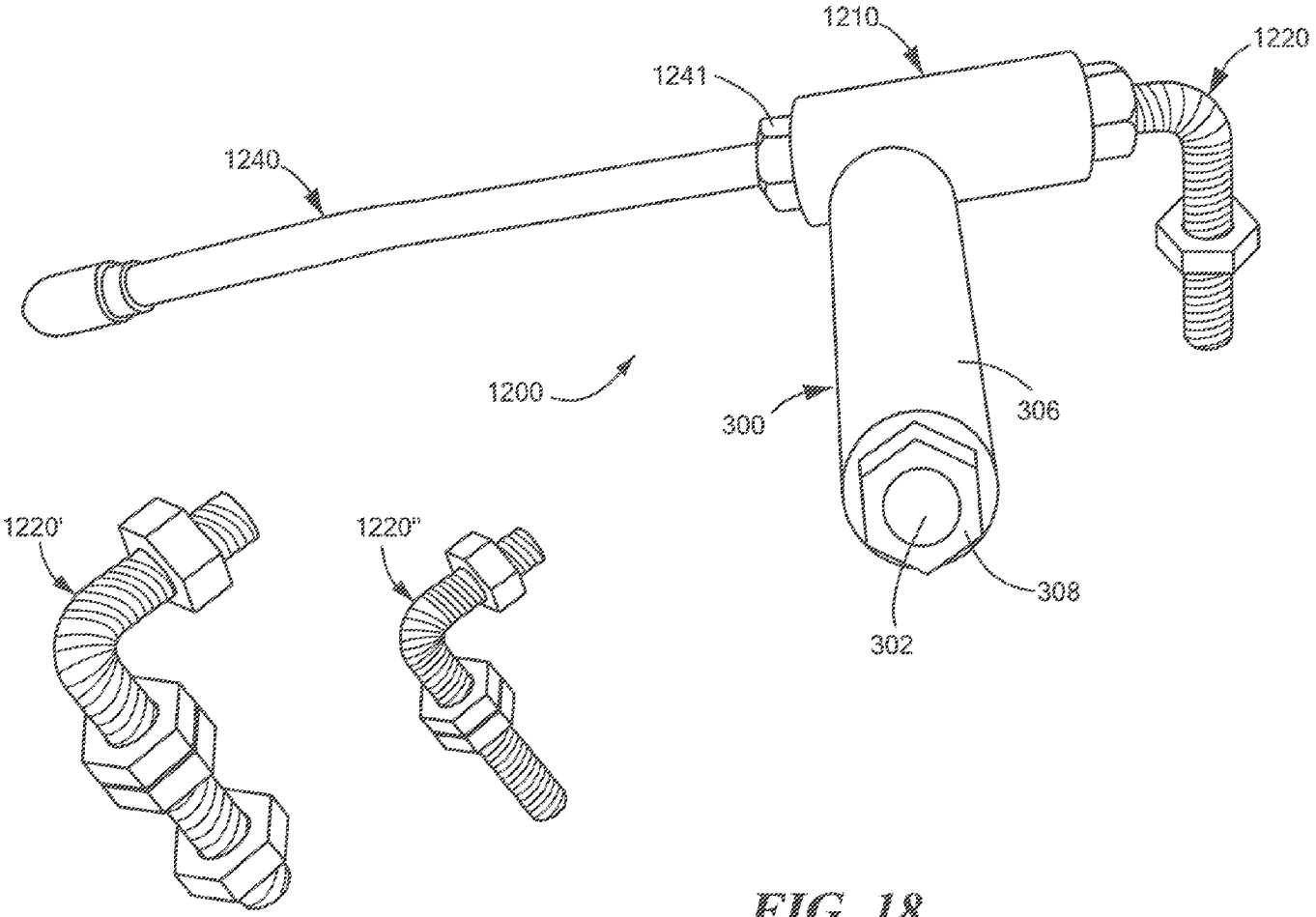
FIG. 18 is a pictorial showing a side perspective view of the example assembly of FIG. 15 and the example bridge engagement mechanisms of the example assembly of FIG. 15.

Referring now to FIG. 18, in which like elements of FIGS. 12 and 15 are shown having like reference designations, a side perspective view of assembly 1200 and bridge engagement mechanisms 1220, 1220', and 1220" is shown.

Figure 19:
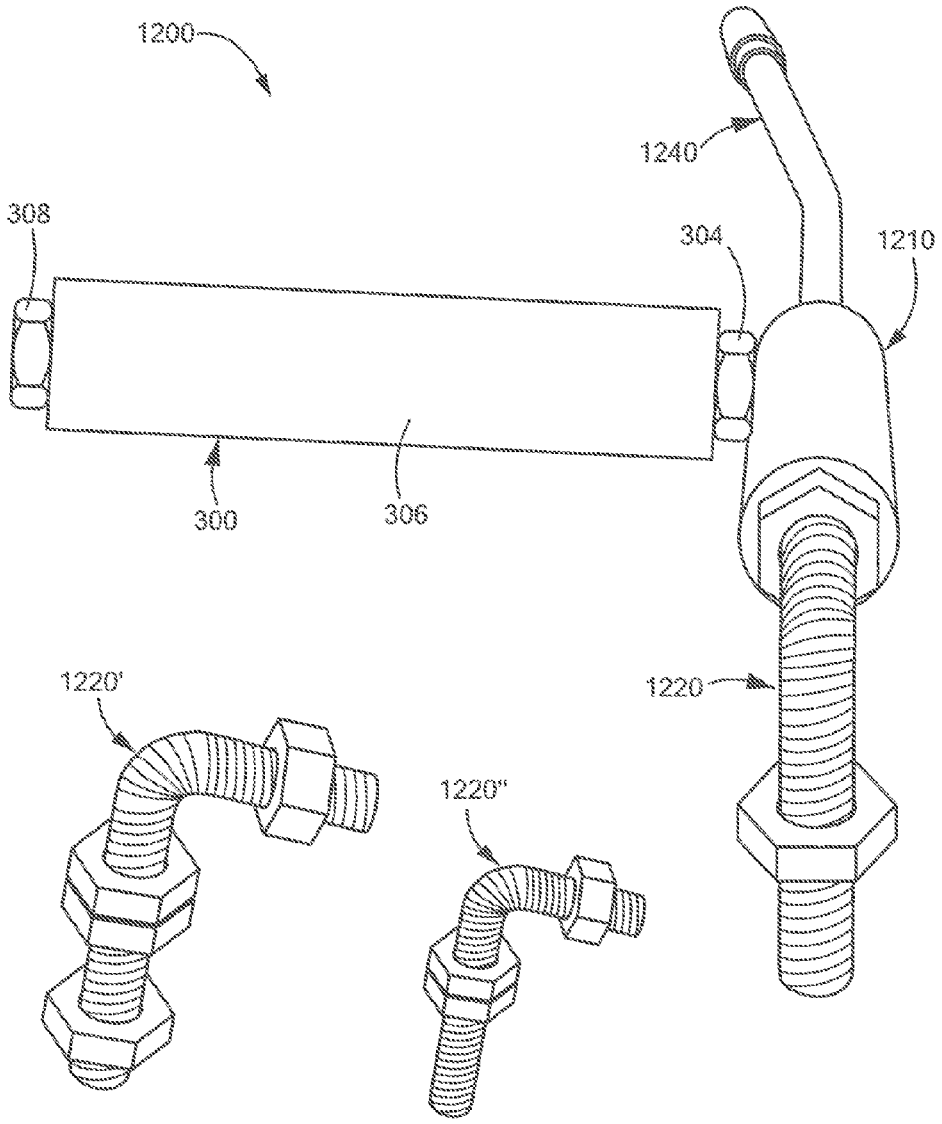
FIG. 19 is a pictorial showing another side perspective view of the example assembly of FIG. 15 and the example bridge engagement mechanisms of the example assembly of FIG. 15.

Referring now to FIG. 19, in which like elements of FIGS. 12 and 15 are shown having like reference designations, another side perspective view of assembly 1200 and bridge engagement mechanisms 1220, 1220', and 1220" is shown.

Figure 20:
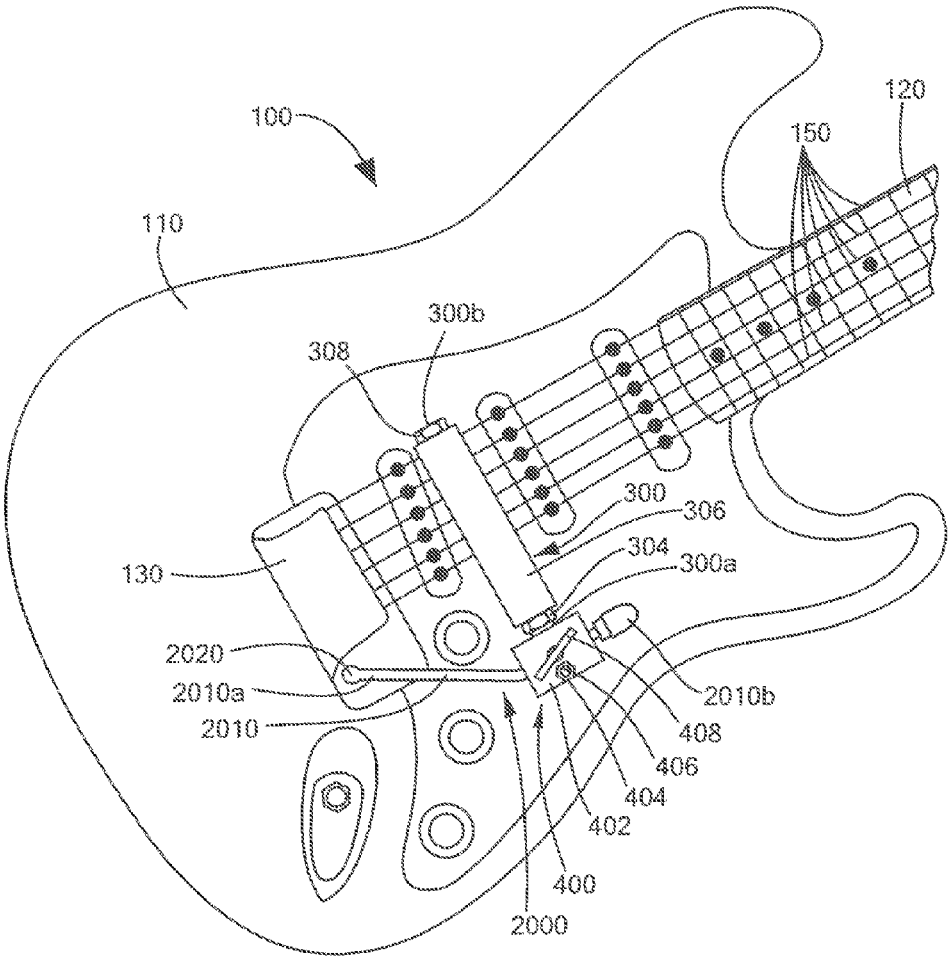
FIG. 20 is a pictorial showing a top perspective view of an example assembly similar to the example assembly of FIG. 8 coupled to a guitar similar to the example guitar of FIG. 1 in one example arrangement.

Referring, now to FIG. 20, in which like elements of FIGS. 1 and 8 are shown having like reference designations, a top perspective view of an assembly 2000 similar to the assembly of FIG. 8 coupled to a Stratocaster style guitar (e.g., guitar 100) is shown. The assembly 200 includes a first elongated member 2010, a bridge engagement mechanism 2020, the second elongated member 300, and the clamp 400. The first elongated member 2010, which may be the same as or similar to a tremolo bar of a Stratocaster style guitar (e.g., tremolo bar 140 of guitar 100) in one embodiment, has first and second opposing ends, 2010*a*, 2010*b*, respectively, similar to the first elongated member 1010 of FIG. 8. Additionally, the bridge engagement mechanism 2020, which may be the same as or similar to the bridge engagement mechanism 1020 of FIG. 8 in one embodiment, is coupled to the first end 2010*a* of the first elongated member 2010 and configured to couple to the bridge of the guitar 100 (e.g., bridge 130 of guitar 100).

In the illustrated embodiment, the second end 300*b* of the second elongated member 300 is coupled proximate to the second end 2010*a* of the first elongated member 2010. In one aspect, the second elongated member 300 is coupled to the first elongated member 2010 such that when coupled a substantially L-shaped assembly (or tremolo bar) is formed. However, in some arrangements, it may be preferred to attach the assembly 1200 to the tremolo bar 140 at a position to leave a small portion of the second end of the first elongated member 2010 exposed as shown, so that a user can actuate the assembly by way of first elongated member 2010 with his or her hand and actuate the assembly by way of the second elongated member 300 using his or her forearm.

While it is shown in FIG. 20 that the major axis of the second elongated member 300 is at a particular angle relative to the major axis of the first elongated member 1010, other angles are possible. In other embodiments, the angle can be any angle within about +/− forty-five degrees of perpendicular.

It should be appreciated that the second elongated member 300 passes over the strings 150, for example, with a Clearance of about 0.5 to about 1.0 inches.

Figure 21:
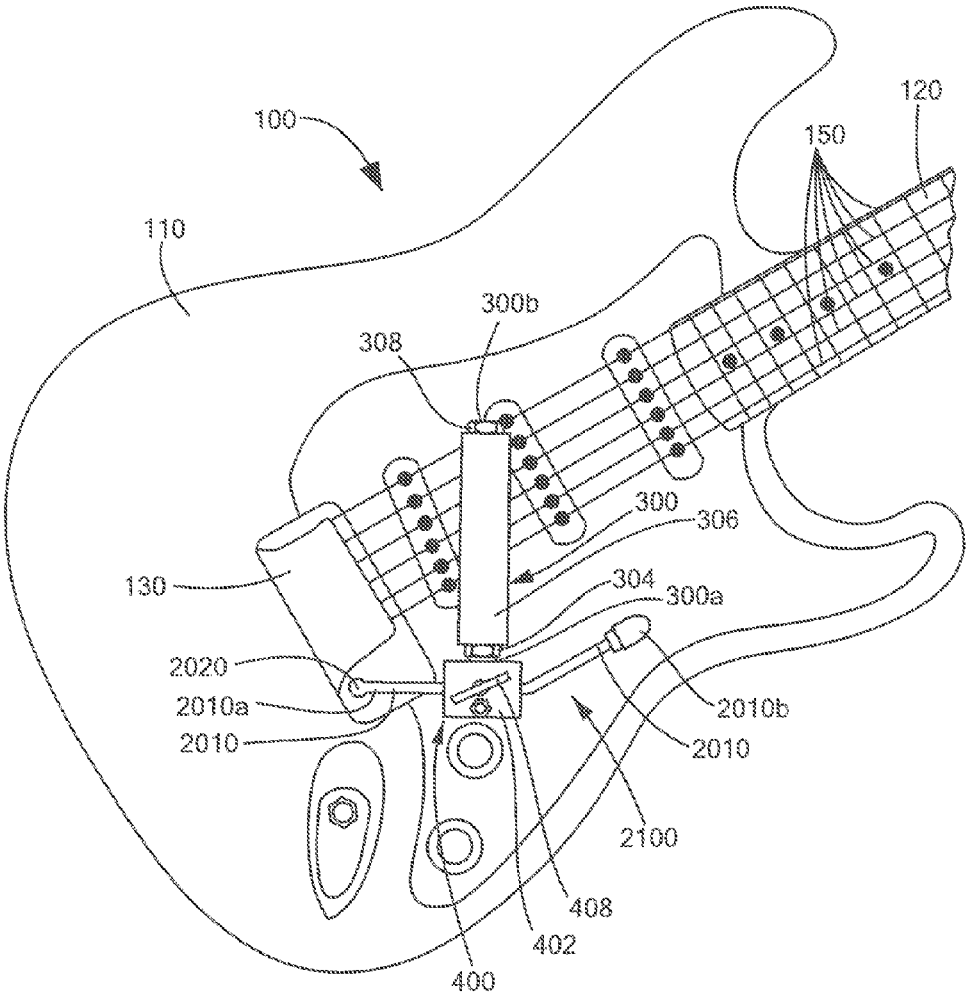
FIG. 21 is a pictorial showing a top perspective view of the example assembly of FIG. 20 coupled to a guitar similar to the example guitar of FIG. 1 in another example arrangement.

Referring now to FIG. 21, in which like elements of FIGS. 1 and 20 are shown having like reference designations, a top perspective view of another assembly 2100 like the assembly 2000 of FIG. 20 coupled to a Stratocaster style guitar (e.g., guitar 100) in another example arrangement is shown. In the illustrated embodiment, the first end 300*a* of the second elongated member 300 is coupled to the first elongated member 2010 at a position approximately equidistant between the first and second ends 2010*a*, 2010*b*, respectively, of the first elongated member 2010 (here, shown closer to the first end of the first elongated member 2010). In one aspect, the second elongated member 300 is coupled to the first elongated member 2010 such that when coupled a substantially T-shaped assembly is formed.

Figure 22:
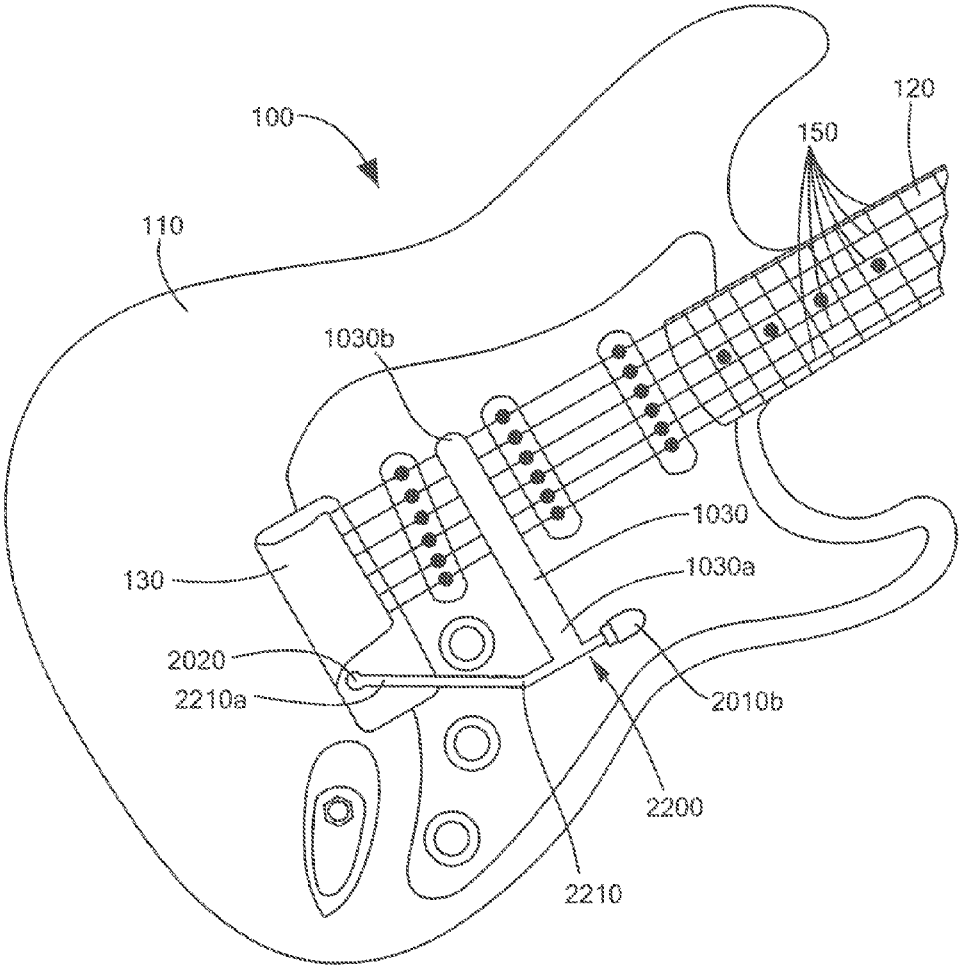
FIG. 22 is a pictorial showing a top perspective view of an example assembly coupled to a guitar similar to the example guitar of FIG. 1.

Referring now to FIG. 22, in which like elements of FIGS. 1, 10 and 20 are shown having like reference designations, a top perspective view of an assembly 2200 similar to the assembly of FIG. 10 coupled to a Stratocaster style guitar (e.g., guitar 100) is shown. The assembly 2200, which can be formed as a one piece structure similar to the assembly of FIG. 10, includes a bridge engagement mechanism 2020 and a rod as a first elongated member 2210 and the second elongated member 1030. In some embodiments, the first and second elongated members 2210, 1030, which each have first and second opposing ends (2210*a*, 2210*b*, 1030*a*, 1030*b*), can have cylindrical surfaces with diameters of about 0.25 inches. However, it should be appreciated that other dimensions and surfaces are possible and the first and second elongated members 2210, 1030 can have different dimensions and/or surfaces, e.g., one flat and one cylindrical. Those of ordinary skill in the art will understand how to select the dimensions and surfaces of the elongated members 2210, 1030 for a particular application (e.g., for a particular type of guitar).

Similar to the assemblies of FIGS. 10 and 20, the first end 2210*a* of the first elongated member 2210 is coupled to a bridge engagement mechanism (e.g., male or female thread) 2020 for coupling to the bridge 130 of the guitar 100. In one embodiment, a major axis of the first elongated member and a major axis of the second elongated member 1030 are substantially perpendicular to each other. In one aspect, such forms a substantially L-shaped assembly. However, as described above, in some arrangements it may be preferred to retain a small portion of the second end of the first elongated member 2210 forming a tab as shown, so that a user can actuate the assembly by way of the first elongated member 2210 or the second elongated member 1030 with his or her hand and actuate the assembly by way of the second elongated member 1030 using his or her forearm.

While it is shown in FIG. 22 that the major axis of the second elongated member 1030 is at a particular angle relative to the major axis of the first elongated member 2210, other angles are possible. In other embodiments, the angle can be any angle within about +/− forty-five degrees of perpendicular.

As illustrated, the assembly 2200 of FIG. 22 has substantially the same appearance as the assembly 2000 of FIG. 20. In one aspect, the functionality of the assembly of FIG. 22 is substantially the same as or similar to the assembly of FIG. 20.

It should be appreciated that the second elongated member 1030 passes over the strings 150, for example, with a clearance of about 0.5 to about 1.0 inches.

Figure 23:
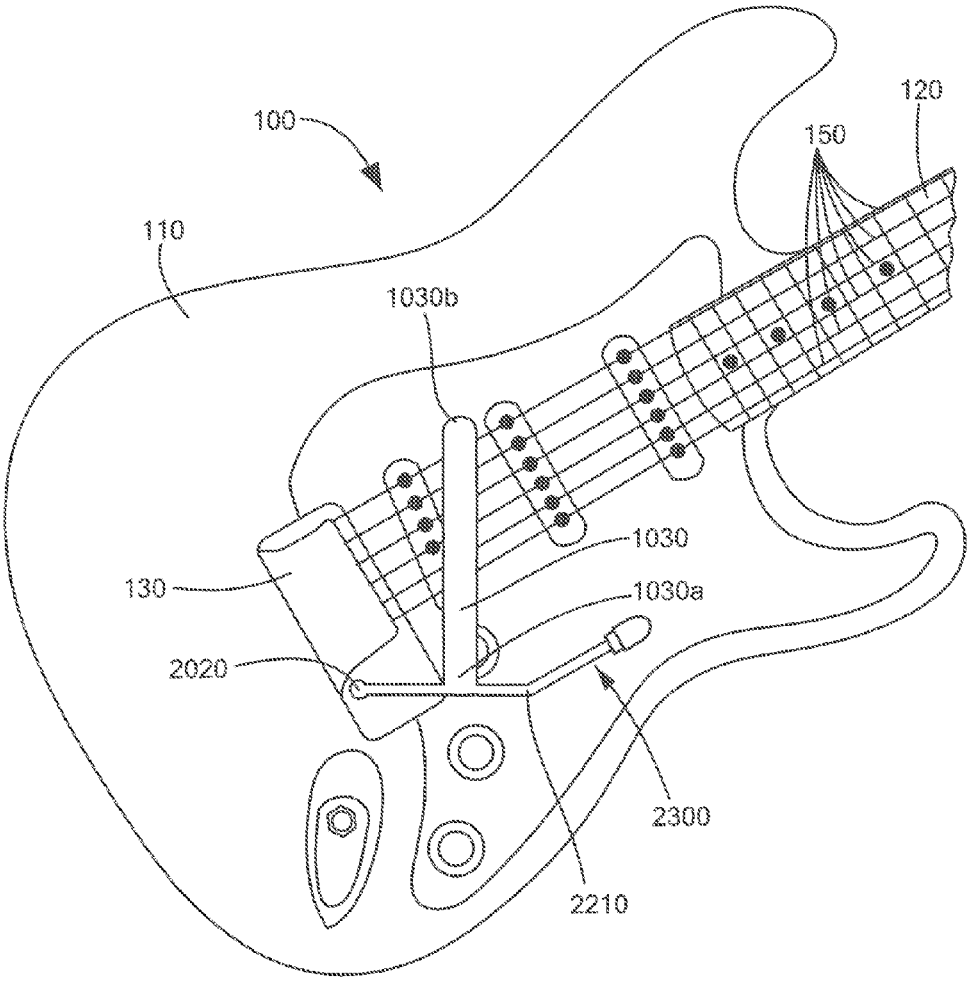
FIG. 23 is a pictorial showing a top perspective view of another example assembly coupled to a guitar similar to the example guitar of FIG. 1.

Referring now to FIG. 23, in which like elements of FIGS. 1, 21 and 22 are shown having like reference designations, a top perspective view of an assembly 2300 like the assembly 2200 of FIG. 22 coupled to a Stratocaster style guitar (e.g., guitar 100) in another example arrangement is shown. In the illustrated embodiment, the first end 1030*a* of the second elongated member 1030 is coupled to the first elongated member 2210 at a position approximately equidistant between first and second ends 2210*a*, 2210*b*, respectively, of the first elongated member 2210 (here, shown slightly closer to the first end of the first elongated member 2210). In one aspect, such forms a substantially T-shaped assembly. As illustrated, the assembly of FIG. 22 has substantially the same appearance as the assembly of FIG. 21. In one aspect, the functionality of assembly of FIG. 23 is substantially the same as or similar to the assembly of FIG. 21.

While it is shown in FIG. 23 that the major axis of the second elongated member 1030 is at a particular angle relative to the major axis of the first elongated member 2220, other angles are possible. In other embodiments, the angle can be any angle within about +/− forty-five degrees of perpendicular.

Figure 24:
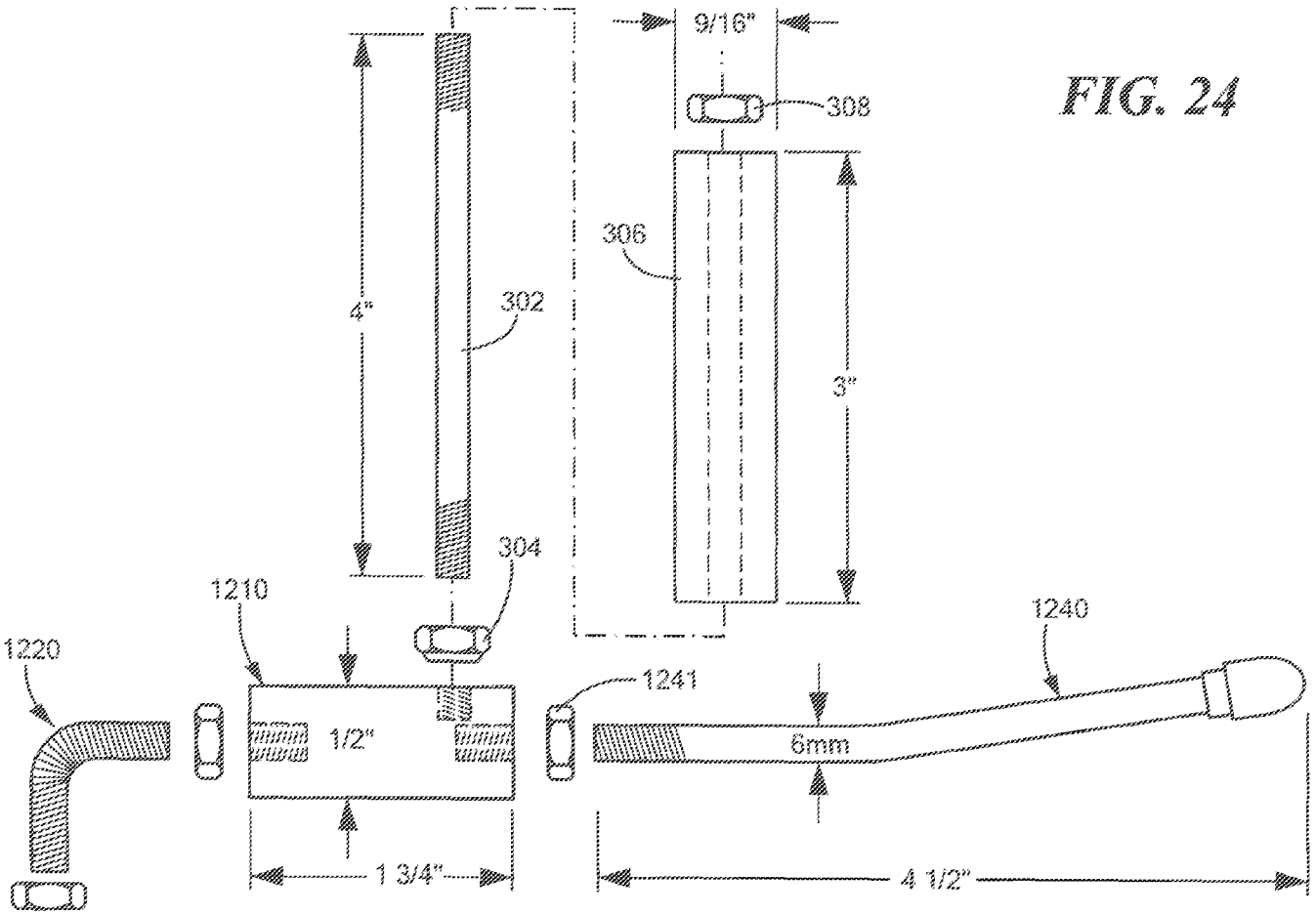
FIG. 24 is a schematic diagram of the example assembly of FIG. 12.

Referring now to FIG. 24, in which like elements of FIG. 12 are shown having like reference designations, a schematic diagram of the assembly of FIG. 12 with example dimensions is shown. As illustrated, the assembly includes the first elongated member 1210, the first elongated member 1210 having a length of about 2.75 inches. Additionally, the assembly includes the bridge engagement mechanism 1220, the bridge engagement mechanism 1220 having a height of about 1.75 inches. The assembly also includes the second elongated member 300, the second elongated member 300 having a height of about 3 inches. Further, the assembly includes a third elongated member 1240, the third elongated member having a length of about 5.75 inches and a diameter of about 6 millimeters. Example dimensions of associated components (e.g., elongated member engagement mechanism 302) and portions (e.g., threaded portions) of the components are also provided. It is to be appreciated that although dimensions are shown in FIG. 24, FIG. 24 is used for illustration purposes and may not be drawn to scale. Dimensions other than those shown may of course be used. Those of ordinary skill in the art will understand how to select the dimensions of the assembly for a particular application (e.g., for a particular type of guitar).

Figure 24A:
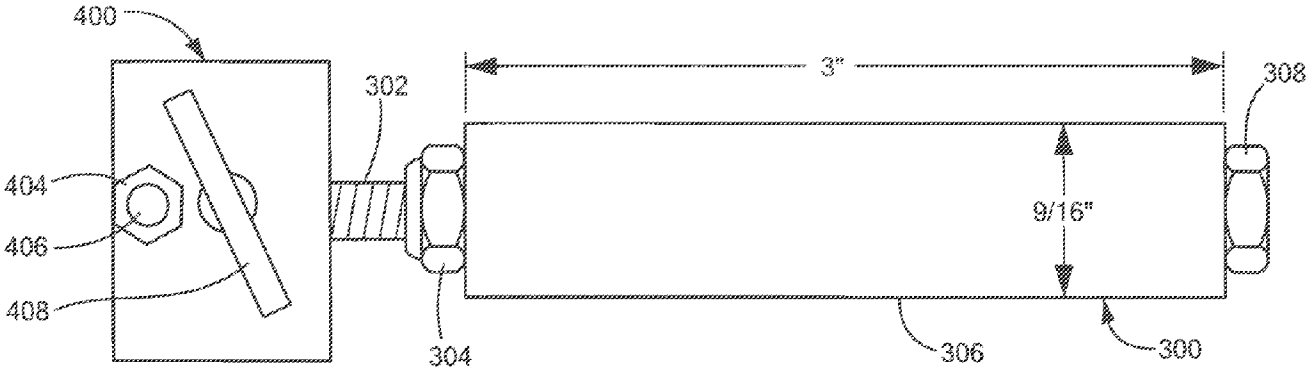
FIG. 24A is a schematic diagram of the example elongated member of FIG. 3.

Referring now to FIG. 24A, in which like elements of FIG. 3 are shown having like reference designations, a schematic diagram of the elongated member 300 and clamp 400 of FIG. 3 with example dimensions is shown. Similar to FIG. 24, it is to be appreciated that although dimensions are shown in FIG. 24A, FIG. 24A is used for illustration purposes and may not be drawn to scale. Dimensions other than those shown may of course be used. Those of ordinary skill in the art will understand how to select the dimensions of the elongated member 300 and the clamp 400 for a particular application (e.g., for a particular type of guitar or assembly).

Figure 24B:
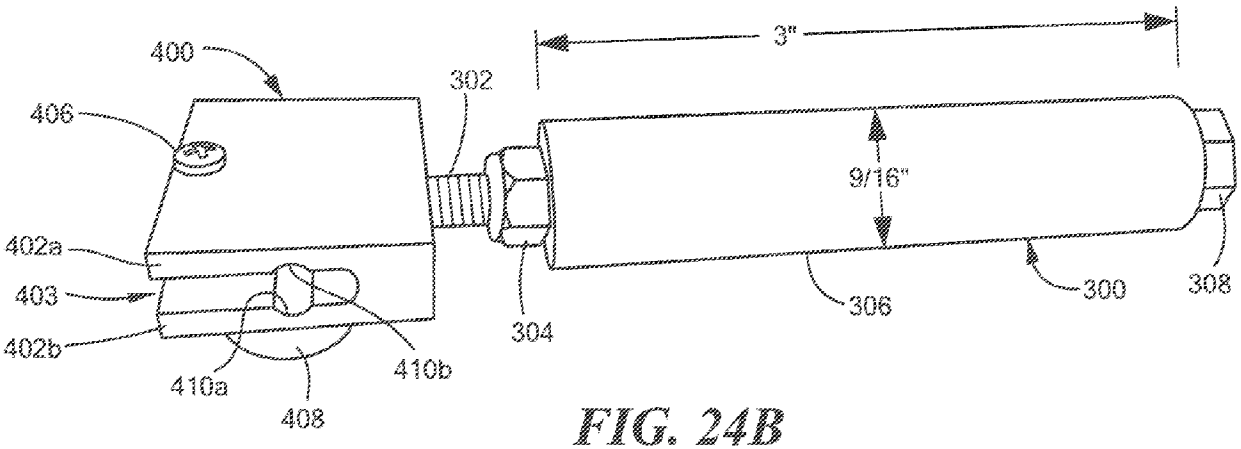
FIG. 24B is a schematic diagram of the example elongated member of FIG. 4.

Referring now to FIG. 24B, in which like elements of FIG. 4 are shown having like reference designations, a schematic diagram of the elongated member 300 and clamp 400 of FIG. 4 with example dimensions is shown. Similar to FIG. 24A, it is to be appreciated that although dimensions are shown in FIG. 24B, FIG. 24B is used for illustration purposes and may not be drawn to scale. Dimensions other than those shown may of course be used. Those of ordinary skill in the art will understand how to select the dimensions of the elongated member 300 and the clamp 400 for a particular application (e.g., for a particular type of guitar or assembly).

Figure 25:
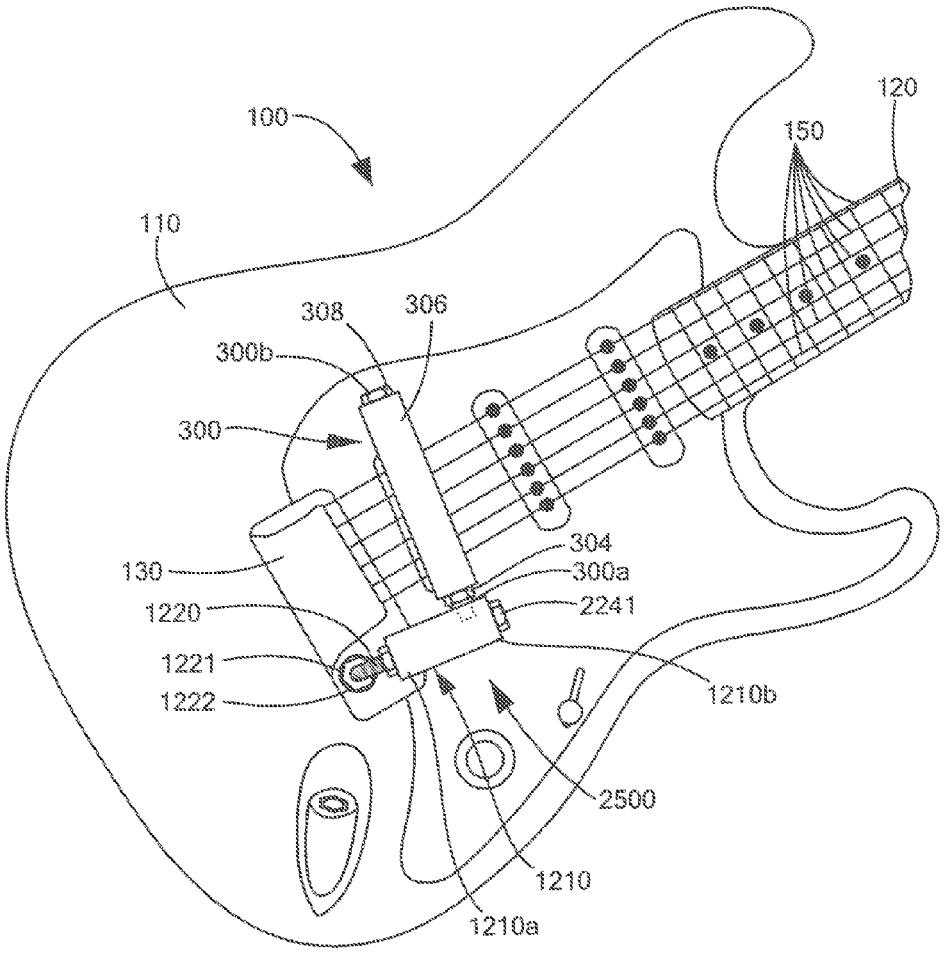
FIG. 25 is a pictorial showing a top perspective view of another example assembly coupled to a guitar similar to the example guitar of FIG. 1.

Referring now to FIG. 25, in which like elements of FIG. 12 are shown having like reference designations, an assembly for attachment to a guitar, which can be the same as or similar to the guitar 100 of FIG. 1 (but could also be the same as or similar to the guitar 200 of FIG. 2), is shown. Similar to the assembly of FIG. 12, the assembly of FIG. 25 includes the first elongated member 1210, the bridge engagement mechanism 1220, the second elongated member 300, and a fastening means 2241 (which may be similar to the nut 1241). In some embodiments, the assembly of FIG. 25 is configured to receive one or more additional elongated members (e.g., 1240, shown in FIG. 12), guitar accessories (e.g., guitar tuners), etc. via the fastening means 2241 and/or a through-hole coupling means (e.g., female threaded hole) proximate the fastening means 2241in the first elongated member 1210. Additionally, in some embodiments, the second elongated member 300 may be decoupled from the assembly in its shown configuration and coupled to the assembly in another configuration (e.g., coupled to the assembly via the fastening means 2241 and/or a through hole coupling means proximate the fastening means 2241 in the first elongated member 1210). The foregoing provides for an assembly that is substantially customizable by a user.

In one aspect of the concepts, systems, and techniques herein, the assembly of FIG. 25 provides a multi-mode assembly. In particular, a user can change a pitch of sounds produced by the guitar by using the assembly in a conventional manner (i.e., push the first and/or second elongated members 1210, 300 of the assembly with his or her hand towards the body of the guitar) in a first mode. However, the user can also use the assembly in another manner. Namely, the user can push on the second elongated member 300 in the illustrated embodiment with a portion of his or her forearm (e.g., a portion of the inner forearm near the wrist up to and including the heel of the hand), in which manner, the user does not need to remove his or her hand from the strings of the guitar, as also discussed with respect to the figures above.

Referring now to FIG. 26, in which like elements of FIG. 12 are shown having like reference designations, an example assembly 2600 for attachment to a guitar, which can be the same as or similar to the guitar 100 of FIG. 1 or the guitar 200 of FIG. 2, is shown. The assembly includes a first elongated member 2610, a bridge engagement mechanism 2620, a second elongated member 2630, a third elongated member 2650, and a fourth elongated member 2640. In one embodiment, such forms an assembly having a "see saw" type shape. The example assembly shown in FIG. 26 is preferably (and in some instance, only) used with Stratocaster style guitars having a "floating bridge" (or a "floating vibrato") type arrangement. As known, "floating bridge" type arrangements provide room for pull up/pull down tremolo movement which can raise or lower pitch of sounds produced by the guitar.

As apparent, the example assembly 2600 includes the second and third elongated members 2630, 2650 which are substantially the same in appearance as the second elongated member of FIG. 12. In particular, the second and third elongated members 2630, 2650 can each include an elongated member engagement mechanism (not shown), fastenings means (e.g., nuts 2634, 2654) and a tube (i.e., rods 2636, 2656, respectively).

Tubes 2636, 2656, like the tube 306 of FIG. 12, can, for example, be a cylindrically shaped piece of stock (e.g., metal, plastic, etc.) having an associated length and the first and seconds ends have an associated diameter. In one embodiment, the associated diameter may be in a range of about 0.25 inches to about 2.0 inches. In a preferred embodiment, the diameter is about 0.56 inches. Additionally, in one embodiment the tubes 2636, 2656 have a compliant (or soft) surface that is responsive to pressure. In one embodiment the associated diameter (e.g., 0.56 inches) and surface characteristics (e.g., compliant surface) are chosen for comfort of an anticipated user and for ease of use of the elongated members (i.e., first and second elongated members 2630, 2650). In one aspect, when coupled to the first elongated member 2610, a line between the first and second ends of the rods 2610 are within about 45 degrees of perpendicular to a major axis of the first elongated member 2610 on which it is coupled.

The first elongated member 2610 has first and second opposing ends 2610*a*, 2610*b*, respectively, arranged along a major axis of the first elongated member 2610*c* and a plurality of portions (e.g., female threaded portions or cavities) coupled to receive the second, third and fourth elongated members 2630, 2650, 1240. The first end 2610*a* of the first elongated member 2610, which is coupled to receive the third elongated member 2650 is proximate a first end of a body of the guitar (e.g., body 110 of guitar 100). Additionally, the second end 2610*a* of the first elongated member 2610, which is coupled to receive at least one of the second or fourth elongated members 2630, 2640, is proximate a second, opposing end of the body of the guitar.

The bridge engagement mechanism 2620, which is configured to couple between the first elongated member 2610 and the bridge (e.g., 130 of FIG. 1) of the guitar (e.g., 100 of FIG. 1), may, for example, serve a central coupling point for coupling the first elongated member 2610 to the bridge 130 of the guitar. In some embodiments, the bridge engagement mechanism 2620 can include a threaded portion (e.g., a male threaded rod) for coupling to the bridge 130 and/or the first elongated member 2610. Additionally, in some embodiments the first elongated member 2610 can include a through-hole coupling means (e.g., female threaded hole) for receiving the bridge engagement mechanism 2620. It is to be appreciated that although the bridge engagement mechanism 2620 is shown coupled to the first elongated member 2610 at a position approximately equidistant between the first and second ends of the first elongated member 2610 in the illustrated embodiment, the bridge engagement mechanism 2620 may of course be coupled at any number of positions between the first and second ends of the first elongated member 2610.

In some embodiments, the first elongated member 2620 may further have a fifth portion (e.g., female threaded portion or cavity), as indicated by reference numeral 2611 in the example embodiment shown. The fifth portion is operable to receive one or more additional elongated members and/or guitar accessories (e.g., guitar tuners), etc. for additional expansion and/or customization of the assembly. The fifth portion may also be operable to receive one or more handle structures, such as those which may be suitable for operating the assembly 2600. Additionally, pieces or accessories (e.g., guitar tuners) may also be coupled to the first elongated member 2620. Also, the fifth portion 2611 may be operable to receive any of the elongated members described herein, with or without the above-described hinged structure or the below-described rotatable structure.

In one aspect of the concepts, systems, and techniques herein, the assembly of FIG. 26 provides a multi-mode tremolo bar. In particular, a user can change a pitch of sounds produced by a guitar (e.g., 100 of FIG. 1 or 200 of FIG. 2) by using the first elongated member 2610 and/or the second elongated member 1240 of the assembly in a conventional manner (i.e., push first elongated member 2610 and/or the second elongated member 1240 with his or her hand towards the body of the guitar) in a first mode. However, the user can also use the assembly in several other manners. Namely, the user can push on the second elongated member 2630 with a portion of his or her forearm (e.g., a first portion of the inner forearm near the wrist up to and including the heel of the hand), in which manner, the user does not need to remove his or her hand from the strings of the guitar. In another mode, the user can push on the fourth elongated member 2650 with a portion of his or her forearm (e.g., a second portion of the inner forearm a hit farther from the wrist), in which manner, the user does not need to remove his or her hand from the strings of the guitar. The foregoing can provide for pull up/pull down tremolo bar movement (if configured in a "floating bridge" arrangement) which can raise or lower a pitch of sounds produced by the guitar on which the assembly is attached.

It is to be appreciated that in some embodiments one or more of the second elongated member 2630, the third elongated member 1240 and the fourth elongated member 2650 are not needed for the assembly shown in FIG. 26. Additionally, in one embodiment, one or more of the second elongated member 2630, the third elongated member 2640, or the fourth elongated member 2650 are removable from the assembly. Such provides for a highly configurable assembly.

While it is shown in FIG. 26 that the major axis of the second elongated member 2630 and the central axis of the third elongated member 2650 are approximately perpendicular relative to the major axis of the first elongated member 2610, other angles are possible. In other embodiments, the angles can be any angle within about +/− forty-five degrees of perpendicular.

Referring now to FIG. 27, in which like elements of FIG. 26 are shown having like reference designations, a top perspective view of the example assembly of FIG. 26 is shown.

In one embodiment, the second region (i.e., end 2630*h*) of the second elongated member 2630 is coupled to the second region (i.e., end 2650*a*) of the third elongated member 2650 by way of a structure 2660 shown in phantom lines. In some embodiments, the structure 2660 can be a separate elongated member coupled, for example by screws or welds. However, in one embodiment, the second elongated member 2630, the third elongated member 2650 and the elongated member 2660 are formed as one contiguous structure, in which case, the second and third elongated members 2630, 2650 do not actually have the second ends 2630*b*, 2650*b*, but instead have second regions 2630*b*, 2650*b*.

Referring now to FIG. 28, in which like elements of FIG. 27 are shown having like reference designations, example elongated members for attachment to the disclosed assemblies (e.g., assemblies of FIG. 12 FIG. 26, etc.) are shown. An elongated member 2800 can, for example, be used in place of the elongated member 1240 of FIG. 12 or the elongated member 2640 of FIG. 27 (e.g., as shown below in conjunction with FIG. 30). The elongated member 2800 can have a threaded end 2830 which may, for example, be threaded and removable from the disclosed assemblies (e.g., assemblies of FIG. 12, FIG. 27, etc.), as shown in FIG. 27, for example, and an opposing end may, for example, comprise a cap 2870. The elongated member 2800 is also shown comprising one or more fastener devices (e.g., rinks) 2810, 2820) for coupling to the threaded end 2830.

Unlike the elongated member 2640 of FIG. 27, however, the elongated member 2800 (which can be a tremolo arm accessory 2800) can include a bendable hinged structure 2850, the bendable hinged structure 2850 bendable about at least one axis. The hinged structure 2850 can include a hinge pin, for example, a screw 2842 and one or more nuts 2860.

When the tremolo arm accessory 2800 is attached to the disclosed assemblies (e.g., assemblies of FIG. 12, FIG. 26, etc.), another multi-mode assembly is provided. In particular, a user can change a pitch of sounds produced by a guitar (e.g., 100 of FIG. 1 or 200 of FIG. 2) by using the assemblies (e.g., assemblies of FIG. 12, FIG. 26, etc.) in the manners discussed above or in combination with the elongated member 2800 with the elongated member 2800 pivoted in various positions (as shown in FIGS. 30-32, for example).

In a first position, the elongated member 2800 can take a relative straight shape and can be operable like the elongated member 1240 or 2640. In a second different position, the elongated member 2800 can be bent downward away from guitar strings, therefore being out of the way of the guitar strings.

Referring now to FIG. 29, in which like elements of FIG. 28 are shown having like reference designations, a side perspective view of the elongated member 2800 of FIG. 28 is shown. The elongated member 2800 is shown next to an example measurement tool (e.g., a rule) 2900 to illustrate example dimensions of the elongated member 2800. It is to be appreciated that although dimensions are shown in FIG. 29, FIG. 29 are used for illustration purposes and the elongated member 2800 can have dimensions that are greater than or less than those shown.

Referring now to FIG. 30, in which like elements of FIGS. 27, 28, and 29 are shown having like reference designations, a top perspective view of the assembly of FIG. 27 including elongated member 2800 of FIG. 28 in place of elongated member 1240 is shown. The elongated member 2800 is shown pivoted in a first example position (of many example positions) with respect to the first elongated member 2610 (and the body of the guitar shown).

In this first position, the elongated member 2800 can be used in the same manner as the elongated member 1240 described above.

Referring now to FIG. 31, in which like elements of FIG. 30 are shown having like reference designations, another top perspective view of the assembly of FIG. 27 including elongated member 2800 of FIG. 28 in place of elongated member 1240 is shown. The elongated member 2800 is shown pivoted in a second example position with respect to the first elongated member 2610 (and the body of the guitar shown).

In this second position, the elongated member 2800 is out of the way of the strings.

In another position (not shown), the elongated member 2800 can be pivoted over the strings and the user can rely upon one or more of the elongated member 2800, the above-described first elongated member 2610, the above-described second elongated member 2630, or the above-described, third elongated member 2650 to change pitch. Additionally, in some embodiments, one or more of the second elongated member 2630 or the third elongated member 2650 can be removed from the example assembly. As one example, the second elongated member 2630 can be removed and the elongated member 2800 can be pivoted over the Strings at a particular angle (e.g., a ninety degree angle) with respect to the first elongated member 2610 such that the user can rely upon the elongated member 2800 or the third elongated member 2650 to change pitch.

Optionally, and not shown., it should be recognize that any of second elongated member 2630, the third elongated member 250, or the fourth elongated members 2640, 1240 can be interchanged upon the first elongated member 2610 and any position and in any combination on the second elongated member. Also, the clamp 400 and/or the hinged structure 2850 can be coupled between any one of the first elongated members described herein and any one of the second, third or fourth elongated members described herein. The above results in an assembly that can be customized to many arrangements.

Also, though not shown herein, a covering cap can be disposed over any one of the second ends of the second, third, or fourth elongated members described herein. The caps can have colors to suit a user.

Referring now to FIG. 32, in which like elements of FIG. 31 are shown having like reference designations, an assembly similar to the assembly of FIG. 31 is shown. Here, however, the elongated member 2800 includes a tube 3200 positioned over one or more portions of the elongated member 2800. The tube 3200 may, for example, provide a grip such that the elongated member 2800 (tremolo arm accessory) can be gripped or otherwise operated by the user in a more comfortable manner. Although the tube 3200 is shown occupying only a portion of the elongated member 2800 in the illustrated embodiment, in some embodiment the tube 3200 may extend the entire (or substantially the entire) length of the elongated member 2800.

Also, as shown, like the elongated member of FIGS. 30 and 31, the elongated member 2800 can be pivoted in any number of positions and can have at least dual usage (e.g., hand control (push/pun forearm control (push down) if suitably swiveled. The foregoing can provide for elongated member 2800 replacing the functionality of second elongated member 2630 in some embodiments. In one embodiment, elongated member 2800 is provided from a tube. Additionally, in one embodiment, elongated member 2800 has a light emitting diode 2870 (LED.) mounted at an end of the elongated member 2800 and elongated member 2800 includes a battery and one or more switches for operating the LED.

Referring now to FIG. 33, in which like elements of FIG. 26 are shown having like reference designations, an example assembly 3300 for attachment to a guitar, which can be the same as or similar to the guitar 100 of FIG. 1 or the guitar 200 of FIG. 2, is shown. The assembly 3300 includes the first elongated member 2610, the bridge engagement mechanism 2620, the second elongated member 2630, and the third elongated member 2650. The assembly 3300 additionally includes a rotatable structure 3360 coupled between the second end of the first elongated member 2610 and the first end of the second elongated member 2630. The rotatable structure 3360 results in the second elongated member 2620 being pivotable about at least one axis, as indicated by the arrow shown in FIG. 33. The assembly is shown pivoted in a first direction (of many potential directions) in FIG. 33.

Referring now to FIG. 34, in which like elements of FIG. 33 are shown having like reference designations, the assembly of FIG. 33 is shown pivoted in a second direction (of many potential directions) by way of the rotatable structure 3360.

Referring now to FIG. 35, in which like elements of FIGS. 4, 20, and 32 are shown having like reference designations, another example assembly for attachment to a guitar (e.g., guitar 100 of FIG. 1) is shown. As illustrated, the clamp 400 is coupled between the first end of elongated member 2800 and first elongated member 2610. Additionally, as illustrated, the hinged structure 2850 can be coupled between the first end 2800*a* of the elongated member 2800 and the clamp 400 is pivotable about at least one axis. Elongated member 2800 is shown pivoted in a first direction (of many potential directions).

Referring now to FIG. 36, in which like elements of FIG. 35 are shown having like reference designations, the assembly 3500 of FIG. 35 is shown pivoted in a second direction (of many potential directions).

Referring now to FIG. 37, in which like elements of FIG. 25 are shown having like reference designations, another example assembly is shown. The assembly includes the first elongated member 1210, the bridge engagement mechanism 1220 and the second elongated member 300. Similar to the assembly of FIG. 25, the first elongated member 1210 has first and second opposing ends 1210*a*, 1210*b*, respectively, arranged along a major axis of the first elongated member 1210. Additionally, similar to the assembly of FIG. 25, the second elongated member 300 has a first region proximate to the first end 300*a* of the second elongated member 300 and a second region proximate to the second end 300*h* of the second elongated member 300.

However, unlike the assembly of FIG. 25, the first end of the first elongated member 1210 extends beyond the bridge of the guitar (e.g., bridge 130 of guitar 100) in a direction of a first end of a body of the guitar (e.g., body 110 of guitar 100), the first end of the body of the guitar being distal from a neck (and, in some embodiments, strings) of the guitar (e.g., neck 120 of guitar 100). The first end 300*a* of the second elongated member 300 is coupled proximate to the first end 1210*a* of the first elongated member 1210. The engagement mechanism 1220 has a first portion coupled to the second end of the first elongated member 1210 and a second portion coupled to the bridge 130 of the guitar. In one embodiment, such configuration provides for operation of the assembly with a wrist and/or forearm of a user.

Referring now to FIG. 38, in which like elements of FIGS. 30 and 32 are shown having like reference designations, an assembly 3810 includes the first elongated member 2610, the bridge engagement mechanism 2620, the second elongated member 2800, and a third elongated member 3800. The third elongated member 3800, which may be similar to third elongated member 2650 of FIG. 30, for example, has a first end 3800*a* coupled proximate to the first end 2610*a* of the first elongated member 2610. The third elongated member 3800 also has at least one concave (or sculpted) surface, as will become further apparent in FIG. 39 below.

Referring now to FIG. 39, in which like elements of FIG. 38 are shown having like reference designations, the elongated member 3800 of the assembly shown in FIG. 38 has a first region proximate to the first end 3800*a* of elongated member 3800 and a second region proximate to the second end 3800*b* of elongated member 3800. In the illustrated embodiment, the first end 3800*a* of elongated member 3800 has an elongated member engagement mechanism 3802 (e.g., male thread rod) for coupling to another elongated member (e.g., first elongated member 2610, shown in FIG. 38) and a support structure 3806. Additionally, the elongated member 3800 has at least one fastening means (e.g., nut 3804) configured to receive a portion of an elongated member engagement mechanism 3802 of the elongated member 3800. In some embodiments, the at least one fastener device may also couple the support structure 3806 to the elongated member engagement mechanism 3802. Additionally, in some embodiments, the elongated member 3800 may include a hinged structure (e.g., similar to the hinged structure 2850 shown in FIGS. 28-32) and/or a rotatable structure (e.g., similar to the rotatable structure 3360 of FIGS. 33 and 34, which may instead be coupled to the fifth portion 2611).

As shown, support structure 3806 has at least one concave (or sculpted) surface. As one example, such at least one concave surface may designed and shaped to support one or more of a user's hand, wrist, palm, forearm, etc. comfortably, regardless of size. It is to be appreciated that the shape of the support structure 3806 shown in FIG. 39 is but one of many potential shapes of support structure 3806.

It is to be appreciated that in all figures discussed above (FIGS. 1-39), all portions referred to as an "elongated member" may be interchangeable elongated members. A first elongated member may be substituted for a second elongated member, the second elongated member may be substituted for a third elongated member, the third elongated member may be substituted for a fourth elongated member, etc. Additionally, all portions referred to as an "elongated member" may be formed as a one piece structure (e.g., a one piece "rigid" structure), and may be provided as part of a one piece assembly or structure (e.g., 2200 of FIG. 22). Further, all portions referred to as an "elongated member" may have same, similar, or different dimensions as other ones of the elongated members. A first elongated member may have same, similar, or different dimensions as a second elongated member, the second elongated member may have same, similar, or different dimensions as a third elongated member, the third elongated member may have same, similar, or different dimensions as a fourth elongated member, etc.

It is to be appreciated that in all figures discussed above (FIGS. 1-39), all portions referred to as a "tube" (e.g., tube 2610) have a length that is sufficient to pass over all strings (e.g., with a clearance of about 0.5 to about 1.0 inches) of the guitar (e.g., guitar 100 of FIG. 1) no matter how many strings the guitar comprises (e.g., 5 strings, 7 strings, etc.).

Additionally, it is to be appreciated that in all figures discussed above (FIGS. 1-39), the elongated members (e.g., 300 of FIG. 12) may be coupled (e.g., threaded, welded, glued, epoxied, snapped or otherwise fastened) and decoupled to or from each other and the disclosed assemblies (e.g., assemblies of FIG. 12, FIG. 26, etc.). Parts associated with and forming the elongated members may also be coupled (e.g., threaded, welded, glued, epoxied, snapped or otherwise fastened) and decoupled to or from each other. Present and future accessories (e.g., a guitar tuner) may, for example, be coupled into or onto the portion where the elongated member (e.g., 300 of FIG. 12) is coupled. Such accessories can also be added to other portions of the disclosed assemblies, as will be apparent. As one example, such accessories may be clamped, fastened, or otherwise coupled to one or surfaces about the length of one or more of the elongated members. Each of the elongated members may also have a "clamp", a "rotatable structure," and/or a "hinged structure," the rotatable structure for rotating the elongated members upward from the plurality of strings in one embodiment and the hinged (or swivel) structure resulting in the elongated members being pivotable about at least one axis in one embodiment. Additionally, each of the clamps, rotatable structures, and/or hinged structures described above can have a locking mechanism (e.g., for restricting movement of the clamps, rotatable structures, and/or hinged structures).

Further, it is to be appreciated a Bigsby® bar can also be called a Bigsby® tremolo arm and vice versa. Additionally, it is to be appreciated that in some embodiments one or more of the elongated members (e.g., 810 of FIG. 8) discussed above can also be called a tremolo arm. Moreover, it is to be appreciated that embodiments described as having a cap (e.g., cap 1245) can include a seamless cap (e.g., a cap integrated into an elongated member), the seamless cap having a smooth contoured rounded end (e.g., similar to that of a cylindrical capsule) instead of or in addition to, a separate cap.

Moreover, it is to be appreciated that in all figures discussed above (FIGS. 1-39), the disclosed assemblies can be utilized with mechanical, electrical, and electro-mechanical bridges mechanisms of a guitar.

As described above and will be appreciated by one of skill in the art, embodiments of the disclosure herein may be configured as a system, method, or combination thereof. Accordingly, embodiments of the present disclosure may be comprised of various means including hardware, software, firmware or any combination thereof. Additionally, it will be appreciated that the concepts, systems, and techniques herein are not limited to use with Stratocaster and Rigsby® style guitars and/or Stratocaster and Bigsby® style tremolo bar systems. In contrast, the concepts, systems, and techniques herein may be found useful with substantially any guitar including, but not limited to, guitars having an ability to use a tremolo bar or tremolo bar like device.

All references cited herein are hereby incorporated herein by reference in their entirety.

Having described preferred embodiments, which serve to illustrate various concepts, structures and techniques, which are the subject of this patent, it will now become apparent to those of ordinary skill in the art that other embodiments incorporating these concepts, structures and techniques may be used. Additionally, elements of different embodiments described herein may be combined to form other embodiments not specifically set forth above. Accordingly, it is submitted that that scope of the patent should not be limited to the described embodiments but rather should be limited only by the spirit and scope of the following claims.

What is claimed is:

1. An assembly for attachment to a guitar, the guitar having a guitar body, a neck, a plurality of strings disposed above at least the guitar body, a bridge coupled to the guitar body and to the plurality of strings, the plurality of strings extending between the bridge and the neck, the guitar body having a first end distal from the neck and a second end proximate to the neck, the assembly comprising:

a first elongated member having first and second opposing ends arranged along a major axis of the first elongated member;

a bridge engagement mechanism coupled to the first elongated member and configured to couple the bridge of the guitar;

a second elongated member having a first region proximate to a first end of the second elongated member and a second region, the first and second regions of the second elongated member arranged along a major axis of the second elongated member with the first end of the second elongated member coupled to the first elongated member;

wherein the major axis of the second elongated member is rigidly arranged or movably arranged to be within about forty-five degrees of perpendicular to the major axis of the first elongated member, wherein the major axis of the second elongated member is rigidly arranged or movably arranged to be within about forty-five degrees of perpendicular to a line parallel to the plurality of strings; and wherein a center of the second elongated member is disposed along the line parallel to the plurality of strings.

2. The assembly of claim 1 wherein the first end of the first elongated member extends beyond the bridge in a direction of the first end of the body of the guitar, and wherein the second elongated member is coupled proximate to the first end of the first elongated member.

3. The assembly of claim 1 wherein the second end of the first elongated member extends beyond the bridge in a direction of the second end of the body of the guitar, and wherein the second elongated member is coupled proximate to the second end of the first elongated member and above ones of the plurality of strings.

4. The assembly of claim 1 wherein the first end of the second elongated member is rigidly coupled to the first elongated member.

5. The assembly of claim 1 wherein the first elongated member and the second elongated member form a contiguous structure.

6. The assembly of claim 1 wherein the first end of the second elongated member is movably coupled to the first elongated member.

7. The assembly of claim 1 further comprising a hinged structure coupled between the first end of the second elongated member and the first elongated member, the hinged structure resulting in the second elongated member being pivotable about at least one axis.

8. The assembly of claim 1 further comprising a rotatable structure coupled between the first end of the second elongated member and the first elongated member, the rotatable structure for rotating the second elongated member upward from the plurality of strings.

9. The assembly of claim 1 further comprising:

a clamp coupled between the first end of the second elongated member and the first elongated member, wherein the clamp is coupled to receive the first end of the second elongated member and the clamp is removably operable to couple to the first elongated member.

10. The assembly of claim 9 further comprising a hinged structure coupled between the clamp and the first end of the second elongated member, the hinged structure resulting in the second elongated member being pivotable about at least one axis.

11. The assembly of claim 1 wherein the first end of the second elongated member is coupled to the first elongated member at a position approximately equidistant between the first and second ends of the first elongated member.

12. The assembly of claim 1 wherein the first end of the second elongated member is coupled proximate to the second end of the first elongated member.

13. The assembly of claim 1 further comprising:

a third elongated member having a first region proximate to a first end of the third elongated member and a second region, the first and second regions of the third elongated member arranged along a major axis of the third elongated member, wherein the first end of the first elongated member extends beyond the bridge in a direction of the first end of the body of the guitar, wherein the second end of the first elongated member extends beyond the bridge in a direction of the second end of the body of the guitar, wherein the first end of the second elongated member is coupled proximate to the second end of the first elongated member, wherein the first end of the third elongated member is coupled proximate to the first end of the first elongated member, and wherein the major axis of the third elongated member is rigidly arranged or movably arranged to be within about forty-five degrees of perpendicular to the major axis of the first elongated member.

14. The assembly of claim 13 further comprising a hinged structure coupled between the first end of the third elongated member and the first elongated member, the hinged structure resulting in the third elongated member being pivotable about at least one axis.

15. The assembly of claim 13 further comprising:

a clamp coupled between the first end of the third elongated member and the first elongated member, wherein the clamp is coupled to receive the first end of the third elongated member and the clamp is removably operable to couple to the first elongated member.

16. The assembly of claim 13 wherein the third elongated member comprises a compliant surface.

17. The assembly of claim 13 wherein the second and third elongated members comprise compliant surfaces.

18. The assembly of claim 13 wherein the first end of the second elongated member is rigidly coupled to the first elongated member, and the first end of the third elongated member is rigidly coupled to the first elongated member.

19. The assembly of claim 13 wherein the first elongated member, the second elongated member, and the third elongated member together from a contiguous structure.

20. The assembly of claim 1 wherein at least one of the first elongated member or the second elongated member is substantially flat.

21. The assembly of claim 1 wherein at least one of the first elongated member or the second elongated member is substantially cylindrically shaped and has an associated diameter.

22. The assembly of claim 21 wherein at least one of the first elongated member or the second elongated member has a diameter that is about 0.56 inches.

23. The assembly of claim 1 wherein the second elongated member comprises a compliant surface.

24. The assembly of claim 1 wherein the second elongated member comprises a threaded portion for coupling to the first elongated member.

25. The assembly of claim 1 wherein the bridge engagement mechanism comprises a threaded portion for coupling to the bridge of the guitar.

26. The assembly of claim 1 further comprising:

a fourth elongated member having first and second opposing ends arranged along a major axis of the fourth elongated member, the first end of the fourth elongated member coupled proximate to the second end of the first elongated member.

27. The assembly of claim 26 further comprising a hinged structure coupled between the first end of the fourth elongated member and the second end of the first elongated member, the hinged structure resulting, in the fourth elongated member being pivotable about at least one axis.

28. The assembly of claim 1 further comprising:

a third elongated member having a first region proximate to a first end of the third elongated member and a second region, the first and second regions of the third elongated member arranged along a major axis of the third elongated member, wherein the first end of the first elongated member extends beyond the bridge in a direction of the first end of the body of the guitar, wherein the second end of the first elongated member extends beyond the bridge in a direction of the second end of the body of the guitar, the assembly further comprising:

a fourth elongated member having first and second opposing ends arranged along a major axis of the fourth elongated member, the first end of the fourth elongated member coupled proximate to the second end of the first elongated member; and a hinged structure coupled between the first end of the fourth elongated member and the second end of the first elongated member, the hinged structure resulting in the second elongated member being pivotable about at least one axis, wherein the second elongated member is coupled proximate to the second end of the first elongated member, wherein the third elongated member is coupled proximate to the first end of the first elongated member, and wherein the major axis of the third elongated member is rigidly arranged or movably arranged to be within about forty-five degrees of perpendicular to the major axis of the first elongated member.

29. The assembly of claim 28 further comprising a hinged structure coupled between the first end of the second elongated member and the first elongated member, the hinged structure resulting in the second elongated member being pivotable about at least one axis.

30. The assembly of claim 28 further comprising a rotatable structure coupled between the first end of the second elongated member and the first elongated member, the rotatable structure for rotating the second elongated member upward from the plurality of strings.

31. The assembly of claim 28 further comprising:

a clamp coupled between the first end of the second elongated member and the first elongated member, wherein the clamp is coupled to receive the first end of the second elongated member and the clamp is removably operable to couple to the first elongated member.

32. The assembly of claim 31 further comprising a hinged structure coupled between the clamp and the first end of the second elongated member, the hinged structure resulting in the second elongated member being pivotable about at least one axis.

33. The assembly of claim 32 wherein at least one of the second elongated member or the third elongated member has a concave surface.

34. The assembly of claim 1 farther comprising at least one washer disposed between a coupling surface on the bridge engagement mechanism and a coupling surface on the bridge, wherein the at least one washer comprises a material that includes rubber, metal, fabric, nylon, leather and/or a synthetic material.

35. The assembly of claim 1 wherein at least one of the first elongated member or the second elongated member has a concave surface.

* * * * *